US012553662B2

(12) United States Patent
Kim et al.

(10) Patent No.: US 12,553,662 B2
(45) Date of Patent: Feb. 17, 2026

(54) REFRIGERATOR

(71) Applicant: SAMSUNG ELECTRONICS CO., LTD., Suwon-si (KR)

(72) Inventors: Gahyeong Kim, Suwon-si (KR); Juno Kwon, Suwon-si (KR); Joonho Park, Suwon-si (KR); Sangmin Park, Suwon-si (KR); Jin Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 124 days.

(21) Appl. No.: 18/525,237

(22) Filed: Nov. 30, 2023

(65) Prior Publication Data

US 2024/0255213 A1 Aug. 1, 2024

Related U.S. Application Data

(63) Continuation of application No. PCT/KR2023/018148, filed on Nov. 13, 2023.

(30) Foreign Application Priority Data

Jan. 31, 2023 (KR) ..... 10-2023-0013340

(51) Int. Cl.
*F25D 23/12* (2006.01)
*F25D 23/02* (2006.01)
*F25D 23/04* (2006.01)

(52) U.S. Cl.
CPC ..... *F25D 23/126* (2013.01); *F25D 23/028* (2013.01); *F25D 23/04* (2013.01); *F25D 2323/122* (2013.01); *F25D 2700/00* (2013.01)

(58) Field of Classification Search
CPC ..... F25D 23/126; F25D 23/028; F25D 23/04; F25D 2331/806
See application file for complete search history.

(56) References Cited

U.S. PATENT DOCUMENTS 9,310,125 B2 4/2016 Kim et al.
10,634,421 B2 4/2020 Shou et al.
(Continued)

FOREIGN PATENT DOCUMENTS

CN 212205301 U 12/2020
JP 2021-187498 A 12/2021
(Continued)

OTHER PUBLICATIONS

International Search Report (PCT/ISA/210) issued Mar. 14, 2024 by the International Searching Authority in International Patent Application No. PCT/KR2023/018148.
(Continued)

*Primary Examiner* — David J Teitelbaum
(74) *Attorney, Agent, or Firm* — Sughrue Mion, PLLC

(57) ABSTRACT

A refrigerator includes: a main body comprising a storage room; a door rotatably coupled to the main body and configured to open or close the storage room; and a water supply device on a rear surface of the door. The water supply device includes: a water supply case comprising a bucket installation space; a water level sensor configured to detect a water level of a water bucket in the bucket installation space; a first water supply port configured to supply water to the water bucket based on the water level of the water bucket that is detected by the water level sensor; a lever in the water supply case and configured to be manually operable; and a second water supply port configured to supply water based on operation of the lever by a user.

13 Claims, 24 Drawing Sheets

(56) References Cited

U.S. PATENT DOCUMENTS

| | | | | |
|---|---|---|---|---|
| 10,794,628 | B2 | 10/2020 | Park et al. | |
| 11,131,499 | B2 | 9/2021 | Jeong et al. | |
| 11,215,394 | B2 | 1/2022 | Park et al. | |
| 11,674,747 | B2 | 6/2023 | Kwon et al. | |
| 2011/0283734 | A1* | 11/2011 | Koo | F25D 23/126 62/389 |
| 2013/0146179 | A1* | 6/2013 | McMahan | B67D 1/1238 141/369 |
| 2017/0343275 | A1 | 11/2017 | Kim | |
| 2018/0187964 | A1* | 7/2018 | Park | F25D 23/02 |
| 2018/0209718 | A1* | 7/2018 | Staud | F25D 23/04 |
| 2020/0355426 | A1 | 11/2020 | Park et al. | |
| 2021/0372687 | A1 | 12/2021 | Hong et al. | |
| 2021/0396459 | A1* | 12/2021 | Kwon | F25D 23/126 |
| 2022/0221218 | A1 | 7/2022 | Kwon et al. | |
| 2023/0083329 | A1 | 3/2023 | Kwon et al. | |

FOREIGN PATENT DOCUMENTS

| | | | |
|---|---|---|---|
| KR | 10-2011-0047370 | A | 5/2011 |
| KR | 10-2018-0080056 | A | 7/2018 |
| KR | 10-2021-0156195 | A | 12/2021 |
| KR | 10-2021-0157130 | A | 12/2021 |
| KR | 10-2338471 | B1 | 12/2021 |
| KR | 10-2022-0022073 | A | 2/2022 |
| KR | 10-2022-0100549 | A | 7/2022 |
| WO | 2019/148765 | A1 | 8/2019 |

OTHER PUBLICATIONS

Written Opinion (PCT/ISA/237) issued Mar. 14, 2024 by the International Searching Authority in International Patent Application No. PCT/KR2023/018148.

Communication issued Jan. 2, 2026 by the European Patent Office in European Patent Application No. 23920119.7.

* cited by examiner

REFRIGERATOR

CROSS-REFERENCE TO RELATED APPLICATIONS

This application is a continuation application of International Application No. PCT/KR2023/018148, filed on Nov. 13, 2023, which claims priority to Korean Patent Application No. 10-2023-0013340, filed on Jan. 31, 2023, in the Korean Intellectual Property Office, the disclosures of which are incorporated by reference herein in their entireties.

BACKGROUND

1. Technical Field

Embodiments of the present disclosure relate to a refrigerator, and more particularly, to a refrigerator having a water supply device.

2. Background Art

A refrigerator is a home appliance for keeping food fresh by including a main body having a storage room and a cool air supply system for supplying cool air to the storage room.

The refrigerator may include a water supply device for providing water to users. The water supply device includes a dispenser for supplying water according to a user's manual operation.

The dispenser supplies water while a user presses a lever. Accordingly, users may receive a small amount of water conveniently through the dispenser. However, there are cases in which a large amount of water is needed. In these cases, users need to continuously press the lever until a sufficient amount of water is collected in a container, which causes the inconvenience to the users.

SUMMARY

An aspect of the present disclosure provides a refrigerator including a water supply device capable of supplying water while a user operates a lever manually and automatically supplying water to a water bucket based on a water level of the water bucket, detected by a water level sensor.

An aspect of the present disclosure includes a refrigerator including a water supply device which has a simple structure, is easily assembled, and provides convenience in use.

An aspect of the present disclosure includes a refrigerator having a large storage space.

An aspect of the present disclosure includes a refrigerator in which a gap between a water supply case and a lever controllably provided in the water supply case is not exposed.

An aspect of the present disclosure includes a refrigerator to/from which a water cork with an improved coupling force is easily attached/detached.

Technical aspects of embodiments of the present disclosure are not limited to the above-mentioned, and other technical aspects not mentioned may be clearly understood by one of ordinary skill in the technical art to which the present disclosure belongs from the following description.

According to embodiments of the present disclosure, a refrigerator may be provided. The refrigerator may include: a main body including a storage room: a door rotatably coupled to the main body and configured to open or close the storage room; and a water supply device on a rear surface of the door. The water supply device may include: a water supply case including a bucket installation space: a water level sensor configured to detect a water level of a water bucket in the bucket installation space: a first water supply port configured to supply water to the water bucket based on the water level of the water bucket that is detected by the water level sensor; a lever in the water supply case and configured to be manually operable; and a second water supply port configured to supply water based on operation of the lever by a user.

According to one or more embodiments of the present disclosure, a distance between the second water supply port and a rotation axis of the door may be larger than a distance between the first water supply port and the rotation axis.

According to one or more embodiments of the present disclosure, the door may include a pair of vertical dykes protruding in a rear direction of the refrigerator and spaced from each other, the pair of vertical dykes may include a first vertical dyke in a first side of the door, the first side being towards a rotation axis of the door, and a second vertical dyke that is in a second side of the door, opposite to the first vertical dyke, and the water supply case may be coupled to the second vertical dyke and spaced from the first vertical dyke.

According to one or more embodiments of the present disclosure, the second vertical dyke may include a dyke bead protruding from an inner side surface of the second vertical dyke, and the water supply case may further include a case bead groove in which the dyke bead is inserted.

According to one or more embodiments of the present disclosure, the water supply case may further include a coupling configured to couple the water supply case to the rear surface of the door.

According to one or more embodiments of the present disclosure, the door may include: a door outer plate: a door inner plate forming the rear surface of the door and coupled to the door outer plate, the door inner plate including an inner plate hole: an insulation provided between the door outer plate and the door inner plate; and a grommet configured to prevent the insulation from entering inside of the storage room, the grommet coupled to the inner plate hole, wherein the water supply case may further include a coupling hole, and the coupling may be coupled to the grommet by penetrating the coupling hole.

According to one or more embodiments of the present disclosure, the refrigerator may further include a door basket in a space between the water supply case and the first vertical dyke, the door basket including a goods space in which goods are configured to be accommodated.

According to one or more embodiments of the present disclosure, the door basket may further include: a first basket bead groove at one surface of the door basket and configured to couple the door basket to the first vertical dyke; and a second basket bead groove formed at another surface of the door basket, opposite to the one surface of the door basket, and configured to couple the door basket to the water supply case.

According to one or more embodiments of the present disclosure, the first basket bead groove may be spaced from the second basket bead groove in front-rear and left-right directions of the refrigerator.

According to one or more embodiments of the present disclosure, the water supply case may further include a lever accommodating groove recessed from a front surface of the water supply case, the lever may be on the lever accommodating groove, and the lever accommodating groove may include a first lever accommodating groove, and a second lever accommodating groove formed inside the first lever accommodating groove in such a way as to form a step with the first lever accommodating groove.

According to one or more embodiments of the present disclosure, the lever may include a lever frame coupled to the water supply case and accommodated in the second lever accommodating groove, and a lever body rotatably coupled to the lever frame and configured to be accommodated in the first lever accommodating groove.

According to one or more embodiments of the present disclosure, the water supply case may further include a lever accommodating groove recessed from a front surface of the water supply case, the lever may be on the lever accommodating groove, and the refrigerator may further include a cover rib protruding from the front surface of the water supply case along borders of the lever accommodating groove.

According to one or more embodiments of the present disclosure, the water supply device may further include a connection tube that includes an inlet and an outlet, the connection tube coupled to the water supply case, the refrigerator may further include a water supply hose configured to supply water to the connection tube, the water supply hose connected to the inlet of the connection tube, and the second water supply port may include a water cork detachably coupled to the outlet of the connection tube.

According to one or more embodiments of the present disclosure, the connection tube may further include a connection tube body, and a plurality of cork fixing rings coupled to an inner circumferential surface of the connection tube body and configured to fix the water cork.

According to one or more embodiments of the present disclosure, the water cork may include a water cork body, and a protrusion ring protruding from an outer circumferential surface of the water cork body, and the protrusion ring may be configured to be coupled between the plurality of cork fixing rings.

DETAILED DESCRIPTION

Figure 1:
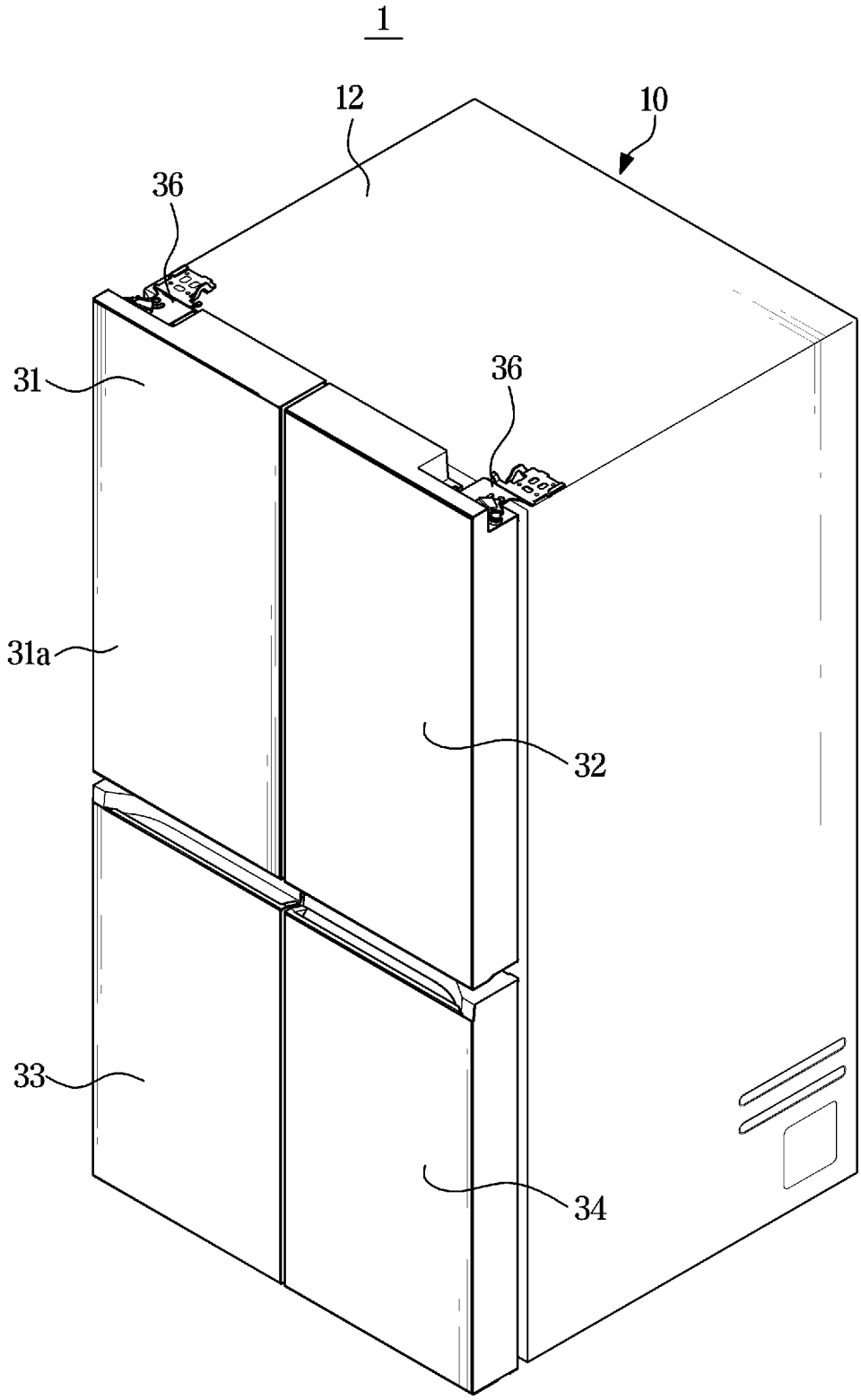
FIG. 1 shows an appearance of a refrigerator according to an embodiment of the present disclosure.

Various embodiments of the present disclosure and terms used therein are not intended to limit the technical features described in the present disclosure to specific embodiments, and should be understood to include various modifications, equivalents, or substitutes of the corresponding embodiments.

In connection with the description of the drawings, similar reference numerals may be used for similar or related components.

The singular form of a noun corresponding to an item may include one or a plurality of the items unless clearly indicated otherwise in a related context.

In the present disclosure, phrases, such as "A or B", "at least one of A and B", "at least one of A or B," "A, B or C," "at least one of A, B and C," and "at least one of A, B, or C", may include any one or all possible combinations of items listed together in the corresponding phrase among the phrases.

As used herein, the term "and/or" includes any and all combinations of one or more of associated listed items.

Terms such as "first" or "second" may be used simply to distinguish a component from other components, without limiting the component in other aspects (e.g., importance or order).

A certain (e.g., a first) component is referred to as "coupled" or "connected" with or without the terms "functionally" or "communicatively" to another (e.g., second) component. When mentioned, it means that any of the above components can be connected to the other components directly (e.g., by wire), wirelessly, or via a third component.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that when a certain component is referred to as being "connected to", "coupled to", "supported by" or "in contact with" another component, it can be directly or indirectly connected to, coupled to, supported by, or in contact with the other component. When a component is indirectly connected to, coupled to, supported by, or in contact with another component, it may be connected to, coupled to, supported by, or in contact with the other component through a third component.

It will also be understood that when a component is referred to as being "on" or "over" another component, it can be directly on the other component or intervening components may also be present.

A refrigerator according to an embodiment of the present disclosure may include a main body.

The "main body" may include an inner case, an outer case positioned outside the inner case, and an insulation provided between the inner case and the outer case.

The "inner case" may include a case, a plate, a panel, or a liner forming a storage room. The inner case may be formed as one body, or may be formed by assembling a plurality of plates together. The "outer case" may form an appearance of the main body, and be coupled to an outer side of the inner case such that the insulation is positioned between the inner case and the outer case.

The "insulation" may insulate inside of the storage room from outside of the storage room to maintain inside temperature of the storage room at appropriate temperature without being influenced by an external environment of the storage room. According to an embodiment of the present disclosure, the insulation may include a foaming insulation. The foaming insulation may be molded by fixing the inner case and the outer case with jigs, etc. and then injecting and foaming urethane foam as a mixture of polyurethane and a foaming agent between the inner case and the outer case.

According to an embodiment of the present disclosure, the insulation may include a vacuum insulation in addition to a foaming insulation, or may be configured only with a vacuum insulation instead of a forming insulation. The vacuum insulation may include a core material and a cladding material accommodating the core material and sealing the inside with vacuum or pressure close to vacuum. The vacuum insulation may further include an adsorbent for adsorbing a gas and water to stably maintain a vacuum state.

However, the insulation is not limited to the above-mentioned foaming insulation or vacuum insulation, and may include various materials capable of being used for insulation.

The refrigerator according to an embodiment of the present disclosure may include the storage room provided inside the main body to store food.

The "storage room" may include a space defined by the inner case. The storage room may further include the inner case defining the space. One side of the storage room may open to enable a user to put food in or take food out. The storage room may store "food" therein. The food may include victual which humans eat and drink, and specifically, the food may include meat, fish, seafood, fruits, vegetables, water, ice, drinks, kimchi, alcoholic beverages such as wine, etc. However, medicines or cosmetics, as well as food, may be stored in the storage room, and goods that may be stored in the storage room are not limited.

The refrigerator may include one or more storage rooms. In a case in which two or more storage rooms are formed in the refrigerator, the respective storage rooms may have different purposes of use, and may be maintained at different temperature. To this end, the storage rooms may be partitioned by a partition wall including an insulation. According to an embodiment of the present disclosure, the partition may be one portion of the main body. According to an embodiment of the present disclosure, the partition may be provided independently from the main body and then assembled into the main body.

The storage room may be maintained within an appropriate temperature range according to a purpose of use, and include a "refrigerating room", a "freezing room", and a "temperature conversion room" according to purposes of use and/or temperature ranges. The refrigerating room may be maintained at appropriate temperature to keep food refrigerating, and the freezing room may be maintained at appropriate temperature to keep food frozen. The "refrigerating" may be keeping food cold without freezing the food, and for example, the refrigerating room may be maintained within a range of 0 degrees Celsius to 7 degrees Celsius. The "freezing" may be freezing food or keeping food frozen, and for example, the freezing room may be maintained within a range of −20 degrees Celsius to −1 degrees Celsius. The temperature conversion room may be used as any one of a refrigerating room or a freezing room according to or regardless of a user's selection. According to an embodiment of the present disclosure, an area of the storage room may be used as a refrigerating room and the remaining area of the storage room may be used as a freezing room.

The storage room may also be called various other terms, such as "vegetable room", "freshness room", "cooling room", and "ice-making room", in addition to "refrigerating room", "freezing room", and "temperature conversion room", and the terms, such as "refrigerating room", "freezing room", "temperature conversion room", etc., as used below need to be understood to represent storage rooms having the corresponding purposes of use and the corresponding temperature ranges.

The refrigerator according to an embodiment of the present disclosure may include a door configured to open or close the open side of the storage room.

The "door" may seal the storage room in a closed state. The door may include an insulation, like the main body, to insulate the storage room in the closed state.

The refrigerator according to an embodiment of the present disclosure may include a cool air supply device for supplying cool air to the storage room.

The "cool air supply device" may include a machine, an apparatus, an electronic device, and/or a combination system thereof, capable of generating cool air and guiding the cool air to cool the storage room.

According to an embodiment of the present disclosure, the cool air supply device may generate cool air through a cooling cycle including compression, condensation, expansion, and evaporation processes of refrigerants. To this end, the cool air supply device may include a cooling cycle device having a compressor, a condenser, an expander, and an evaporator to drive the cooling cycle. According to an embodiment of the present disclosure, the cool air supply device may include a semiconductor such as a thermoelectric element. The thermoelectric element may cool the storage room by heating and cooling actions through the Peltier effect.

The refrigerator according to an embodiment of the present disclosure may include a machine room where at least some components belonging to the cool air supply device are installed.

The "machine room" may be partitioned and insulated from the storage room to prevent heat generated from the components installed in the machine room from being transferred to the storage room. To dissipate heat from the components installed inside the machine room, the machine room may communicate with outside of the main body.

The refrigerator according to an embodiment of the present disclosure may include a controller for controlling the refrigerator.

The "controller" may include a memory for storing and/or memorizing data and/or programs for controlling the refrigerator, and a processor for outputting control signals for controlling the cool air supply device, etc. according to the programs and/or data memorized in the memory.

The memory may memorize programs and/or data for controlling components included in the refrigerator, and memorize temporary data generated while a control signal for controlling the components included in the refrigerator is generated.

The processor may process a user input received through a user interface according to the programs and/or data stored/memorized in the memory, and generate a control signal for controlling an operation of the user interface and/or an operation of the cool air supply device. For example, the processor may receive temperature information of the storage room from a temperature sensor, and generate a cooling control signal for controlling an operation of the cool air supply device based on the temperature information of the storage room. The processor may receive a user input from the user interface, and transfer a display control signal for displaying an image on the user interface and image data to the user interface in response to the user input.

The controller may include, in addition to or as an alternative to the processor and memory for controlling all the components included in the refrigerator, a plurality of processors and a plurality of memories for individually controlling the components of the refrigerator. For example, the controller may include a processor and a memory that control operations of the cool air supply device according to an output from the temperature sensor, and a processor and a memory that control operations of the user interface according to a user input. The processor and the memory may be provided integrally or separately. The processor may include a plurality of processors, and the memory may include a plurality of memories.

Hereinafter, an embodiment of the present disclosure will be described in detail with reference to the appended drawings.

Figure 2:
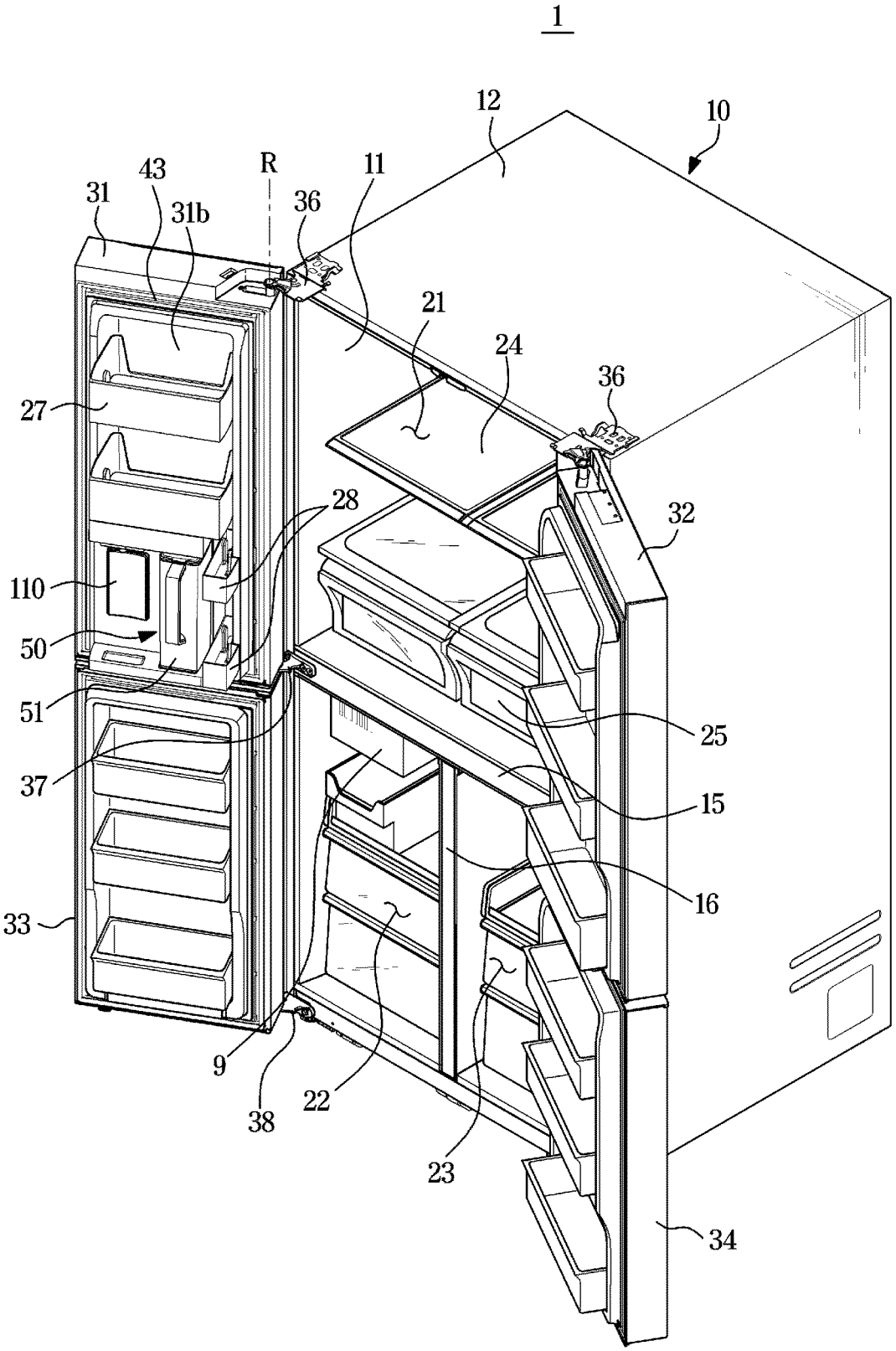
FIG. 2 shows a refrigerator according to an embodiment of the present disclosure while doors of the refrigerator are open.
Figure 3:
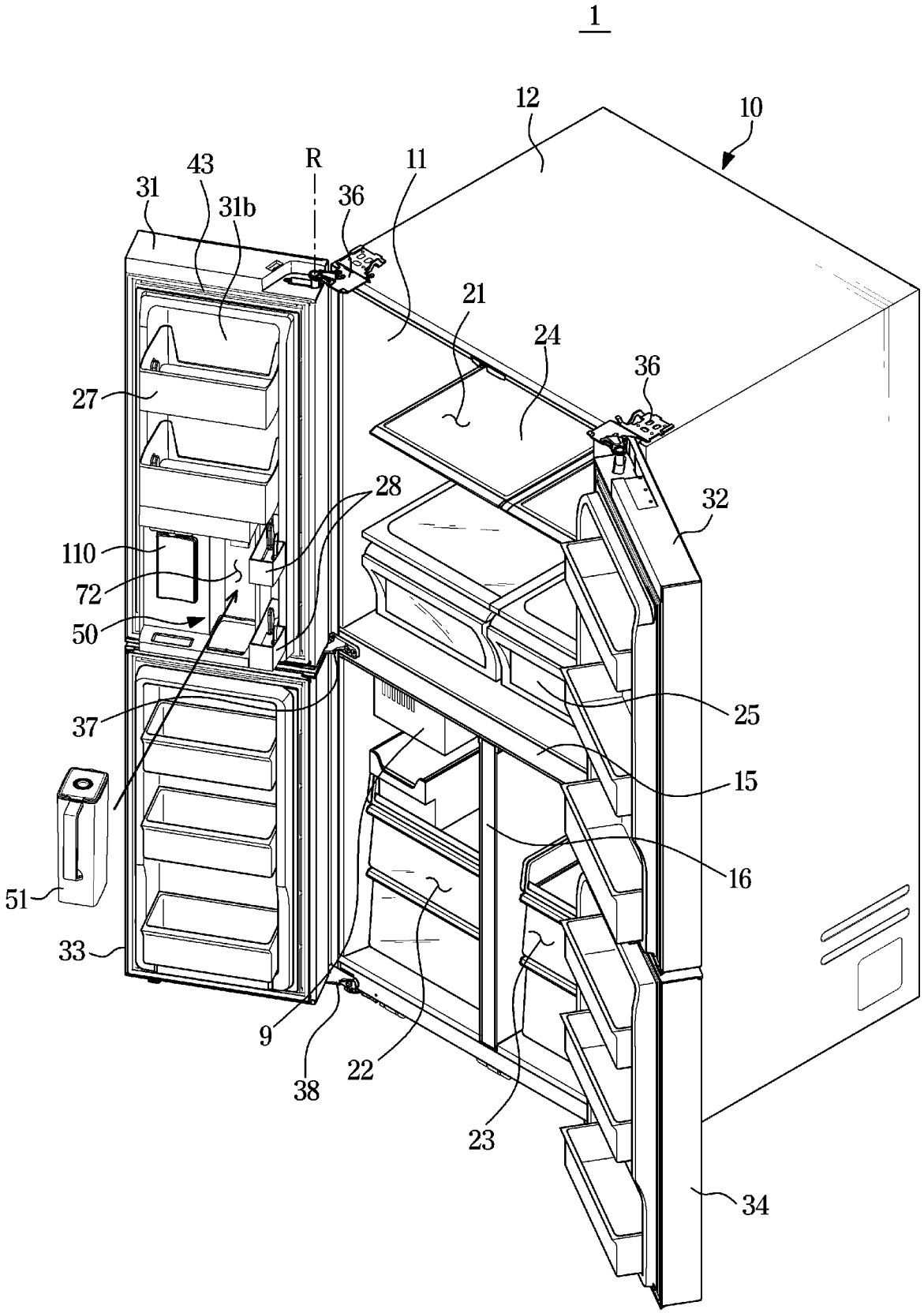
FIG. 3 shows a state of a refrigerator in which a water bucket is separated from a water supply device according to an embodiment of the present disclosure.
Figure 4:
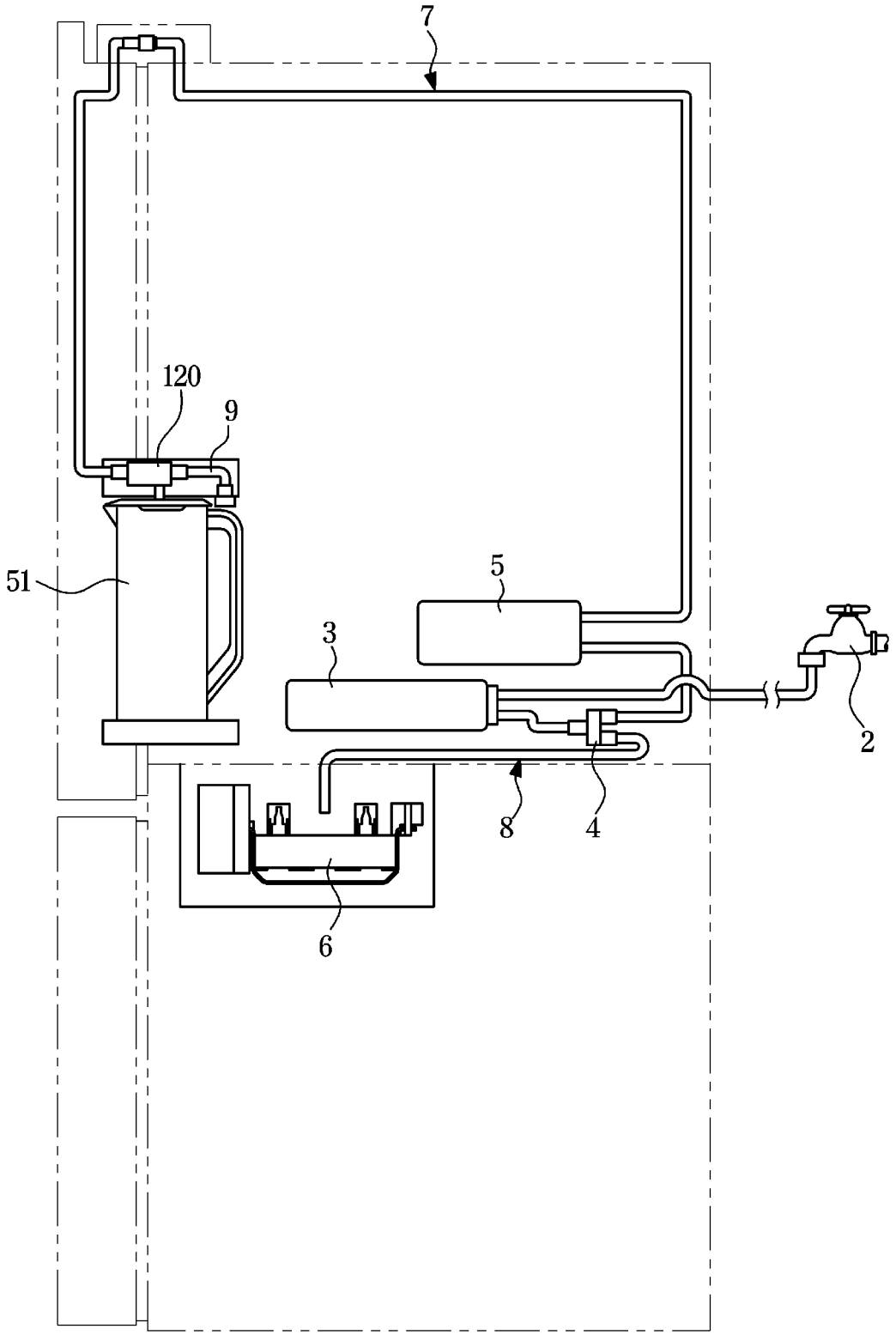
FIG. 4 schematically shows main components of a refrigerator according to an embodiment of the present disclosure.

FIG. 1 shows an appearance of a refrigerator according to an embodiment of the present disclosure. FIG. 2 shows a refrigerator according to an embodiment of the present disclosure while doors of the refrigerator open. FIG. 3 shows a state of a refrigerator in which a water bucket is separated from a water supply device according to an embodiment of the present disclosure. FIG. 4 schematically shows main components of a refrigerator according to an embodiment of the present disclosure.

As shown in FIGS. 1 to 4, a refrigerator 1 according to an embodiment of the present disclosure may include a main body 10, storage rooms 21, 22, and 23 formed inside the main body 10, doors 31, 32, 33, and 34 for opening or closing the storage rooms 21, 22, and 23, and a cool air supply device (not shown) for supplying cool air to the storage rooms 21, 22, and 23.

The main body 10 may include an inner case 11 forming the storage rooms 21, 22, and 23, an outer case 12 coupled to an outer side of the inner case 11 and forming an appearance, and an insulation (not shown) provided between the inner case 11 and the outer case 12 to insulate the storage rooms 21, 22, and 23.

The storage rooms 21, 22, and 23 may be partitioned into a plurality of storage rooms by a horizontal partition wall 15 and a vertical partition wall 16. The storage rooms 21, 22, and 23 may be partitioned into an upper storage room 21 and lower storage rooms 22 and 23 by the horizontal partition wall 15, and the lower storage rooms 22 and 23 may be partitioned into a left lower storage room 22 and a right lower storage room 23 by the vertical partition wall 16.

The upper storage room 21 may be used as a refrigerating room, and the lower storage rooms 22 and 23 may be used as freezing rooms. At any one of the lower storage rooms 22 and 23, an ice maker 6 for making ice may be provided. However, the above-described partitioning and purposes of use of the storage rooms 21, 22, and 23 are only examples, and embodiments of the present disclosure are not limited thereto.

According to an embodiment of the present disclosure, the refrigerator may be a Side By Side (SBS) type in which storage rooms are partitioned into left and right storage rooms by a vertical partition wall, a French Door Refrigerator (FDR) type in which storage rooms are partitioned into an upper refrigerating room and a lower freezing room by a horizontal partition wall, or a one door type having one storage room and one door.

Inside the storage rooms 21, 22, and 23, at least one shelf 24 on which food is put and at least one storage container 25 for storing food may be provided.

The cool air supply device may generate cool air by using a cooling circulation cycle of compressing, condensing, expanding, and evaporating a refrigerant, and supply the generated cool air to the storage rooms.

The upper storage room 21 may be opened or closed by a pair of doors 31 and 32. The doors 31 and 32 may be rotatably coupled to the main body 10 by an upper hinge 36 and a middle hinge 37. At any one door of the pair of doors, a filler for preventing cool air of the storage room 21 from leaking out between the pair of doors 31 and 32 in a closed state of the pair of doors 31 and 32 may be provided.

The left and lower storage room 22 may be opened or closed by the door 33, and the right and lower storage room 23 may be opened or closed by the door 34. The door 33 and the door 34 may be rotatably coupled to the main body 10 by a middle hinge 37 and a lower hinge 38.

The doors 31, 32, 33, and 34 may include front surfaces 31*a* and rear surfaces 31*b*. The front surfaces 31*a* of the doors 31, 32, 33, and 34 may be surfaces exposed to outside of the refrigerator 1 in closed states of the doors 31, 32, 33, and 34. The rear surfaces 31*b* of the doors 31, 32, 33, and 34 may be surfaces exposed to the storage rooms 21, 22, and 23 in the closed states of the doors 31, 32, 33, and 34. The rear surfaces 31*b* of the doors 31, 32, 33, and 34 may form front sides of the storage rooms 21, 22, and 23.

On each of the rear surfaces 31*b* of the doors 31, 32, 33, and 34, a gasket 43 that is tightly pressed to a front surface of the main body 10 to seal the storage rooms 21, 22, and 23 may be provided.

The doors 31, 32, 33, and 34 may include door baskets 27 and 28 having goods spaces for storing goods therein. The door baskets 27 and 28 may be provided on the rear surfaces 31*b* of the doors 31, 32, 33, and 34. Goods stored in the goods spaces of the door baskets 27 and 28 may be cooled by cool air of the storage rooms 21, 22, and 23 while the doors 31, 32, 33, and 34 are in the closed states.

On the rear surface 21*b* of the door 31, a water supply device 50 may be provided. According to an embodiment of the disclosure, the water supply device 50 may be provided at a left and upper door 31, although not limited thereto. However, for example, the water supply device 50 may be provided in a right and upper door 32.

The water supply device 50 may supply water to a user. The water supply device 50 may include a lever 110 that is controllable. While the user operates the lever 110, the water supply device 50 may supply water. More specifically, while the user presses the lever 110, the water supply device 50 may supply water. At a time at which the user stops pressing the lever 110, the water supply device 50 may stop supplying water.

Figure 5:
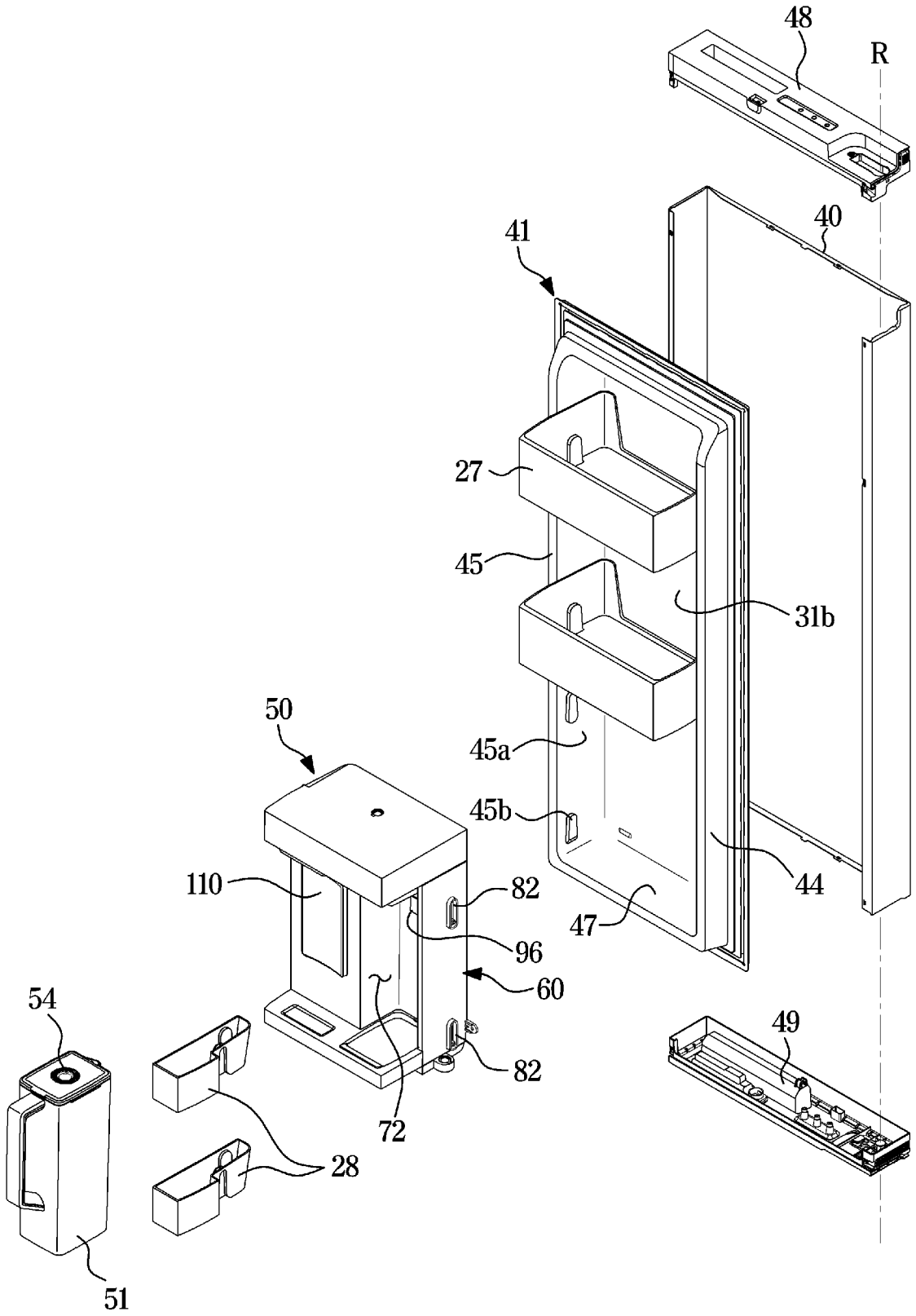
FIG. 5 shows a disassembled state of a door and a water supply device according to an embodiment of the present disclosure.

The water supply device 50 may include a water bucket 51 that is detachably installed in a bucket installation space 72 of a water supply case 60 (see FIG. 5). The water supply device 50 may include a water level sensor 96 (see FIG. 5) for detecting a water level of the water bucket 51 after the water bucket 51 is installed in the bucket installation space 72. The water supply device 50 may supply water to the water bucket 51 based on the water level of the water bucket 51, detected by the water level sensor 96. For example, the water supply device 50 may supply water to the water bucket 51 until the water level of the water bucket 51 reaches a preset water level. According to identification that the water level of the water bucket 51 has reached the preset water level, the water supply device 50 may stop supplying water to the water bucket 51.

That is, according to the current embodiment, the water supply device 50 may supply water according to a user's operation of manually operating the lever 110, or may supply water based on a water level of the water bucket 51, detected by the water level sensor 96, although not limited thereto. According to embodiments, the water supply device 50 may have anyone of the above-described functions.

According to the current embodiment, because the water supply device 50 is provided on the rear surface 31*b* of the door 31, the water supply device 50 may be covered by the door 31 and not exposed to the outside while the door 31 is in the closed state. Accordingly, while the door 31 is in the closed state, access to the water supply device 50 may be not allowed.

While the door 31 is in the closed state, the water supply device 50 may face the storage room 21. While the door 31 is in the closed state, the water supply device 50 may be positioned inside the storage room 21. While the door 31 is in the closed state, the water supply device 50 may be cooled by cool air of the storage room 21. That is, water filled in the water bucket 51 may be cooled by cool air of the storage room 21.

After the door 31 opens, a user may access the water supply device 50. That is, after the door 31 opens, the user may install the water bucket 51 in the bucket installation space 72 or detach the water bucket 51 from the bucket installation space 72. After the door 31 opens, the user may operate the lever 110 to receive water.

The bucket installation space 72 and the lever 110 may be positioned in a left-right direction. Specifically, as shown in FIG. 2, the lever 110 may be positioned farther from a rotation axis R of the door 31 than the bucket installation space 72 and the water bucket 51 installed in the bucket installation space 72.

Upon installation of the water bucket 51 in the bucket installation space 72, the water bucket 51 may further protrude farther than the lever 110, and because the lever 110 is positioned farther from the rotation axis R of the door 31 than the water bucket 51 installed in the bucket installation space 72, the user may operate the lever 110 conveniently without interference from the water bucket 51.

The refrigerator may include a first water supply port 151 (see FIGS. 7, 8, and 11) for supplying water to the water bucket 51 based on a water level of the water bucket 51. The refrigerator 1 may include a second water supply port 152 (see FIGS. 7, 8, and 18) for supplying water based on an operation of the lever 110.

The first water supply port 151 may be positioned above the water bucket 51 installed in the bucket installation space 72 to supply water to the water bucket 51 installed in the bucket installation space 72.

The user may hold a container, such as a cup, a bowl, or a bottle, with his/her hand and press the lever 110 with the container, and the second water supply port 152 may be positioned above the lever 110 to supply water to the container pressing the lever 110.

As the bucket installation space 72 and the lever 110 are positioned in the left-right direction with respect to each other, the first water supply port 151 and the second water supply port 152 may also be positioned in the left-right direction with respect to each other. More specifically, the second water supply port 152 may be positioned farther from the rotation axis R of the door 31 than the first water supply port 151.

Accordingly, as described above, the user may operate the lever 110 conveniently without interference from the water bucket 51 to receive water from the second water supply port 152.

However, the position of the lever 110 may be switched with the position of the bucket installation space 72, and the position of the first water supply port 151 may be switched with the position of the second water supply port 152.

As shown in FIG. 4, the refrigerator 1 may include a water supply flow path 7 for supplying water to the first water supply port 151 and the second water supply port 152.

The refrigerator 1 may include a switching valve 120 for selectively supplying water to any one of the first water supply port 151 or the second water supply port 152.

The water supply flow path 7 may connect a water supply source 2 to the switching valve 120 to supply water of the water supply source 2 to the switching valve 120. The water supply source 2 may include an external water supply source such as a faucet. The water supply flow path 7 may extend from the main body 10 to the door 31. The water supply flow path 7 may be formed by connecting at least one water supply hose.

On the water supply flow path 7, a filter 3 for purifying water of the water supply source 2 may be provided. Also, on the water supply flow path 7, a water cooling tank 5 for storing water purified by the filter 3 may be provided. The water cooling tank 5 may be provided in the storage room 21 to be cooled by cool air of the storage room 21.

The refrigerator 1 may include the ice maker 6 for making ice. The refrigerator 1 may include an ice maker flow path 8 for supplying water to the ice maker 6. The ice maker flow path 8 may diverge from a certain location of the water supply flow path 7. At the location where the ice maker flow path 8 diverges from the water supply flow path 7, a water supply valve 4 may be provided. The water supply valve 4 may selectively supply water supplied from the water supply source 2 to the switching valve 120 through the water supply flow path 7, or supply water supplied from the water supply source 2 to the ice maker 6 through the ice maker flow path 8. Also, the water supply valve 4 may close the water supply flow path 7 and the ice maker flow path 8 to prevent water of the water supply source 2 from being supplied to the switching valve 120 and the ice maker 6.

Accordingly, water of the water supply source 2 may be, upon opening of the water supply flow path 7 by the water supply valve 4, supplied to the switching valve 120 according to water pressure of the water supply source 2.

The switching valve 120 may supply water supplied through the water supply flow path 7 selectively to the first water supply port 151 or the second water supply port 152. A water supply hose 9 may be provided between the switching valve 120 and the second water supply port 152 (see FIG. 7).

Figure 6:
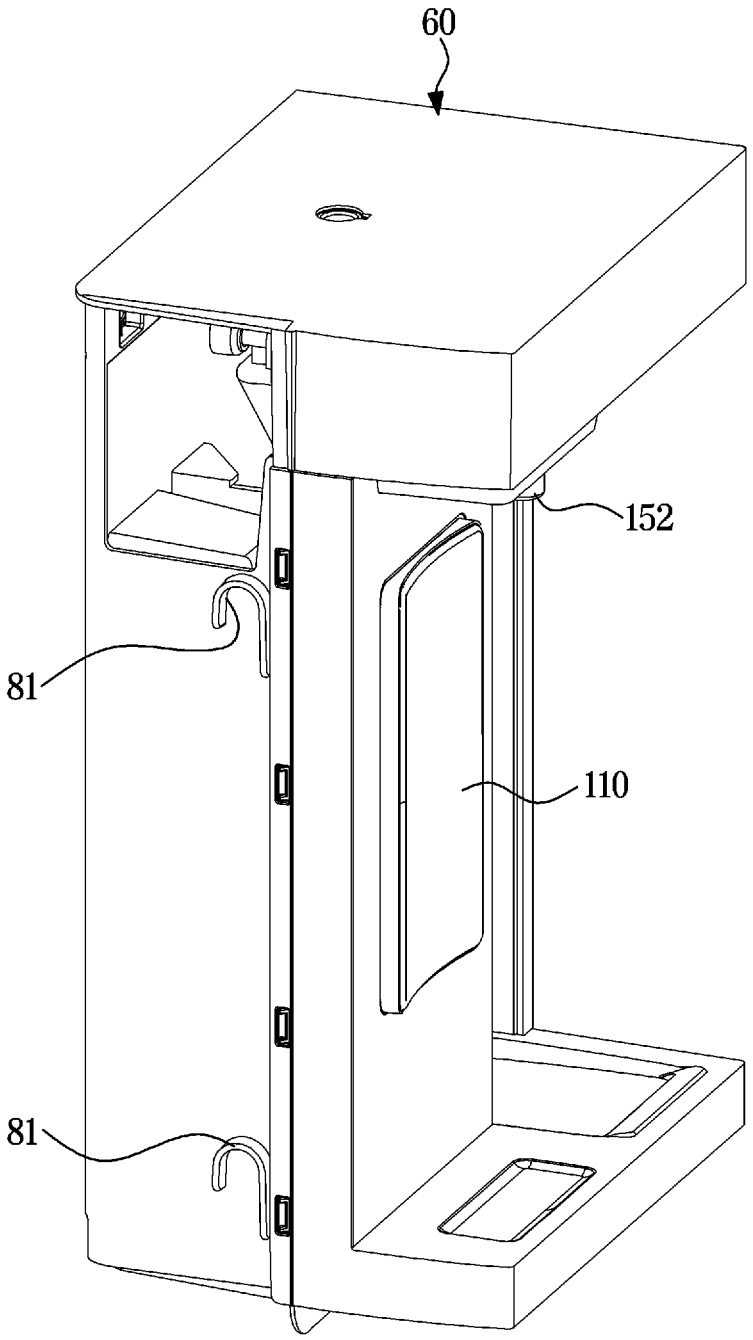
FIG. 6 shows a side of a water supply device according to an embodiment of the present disclosure.
Figure 7:
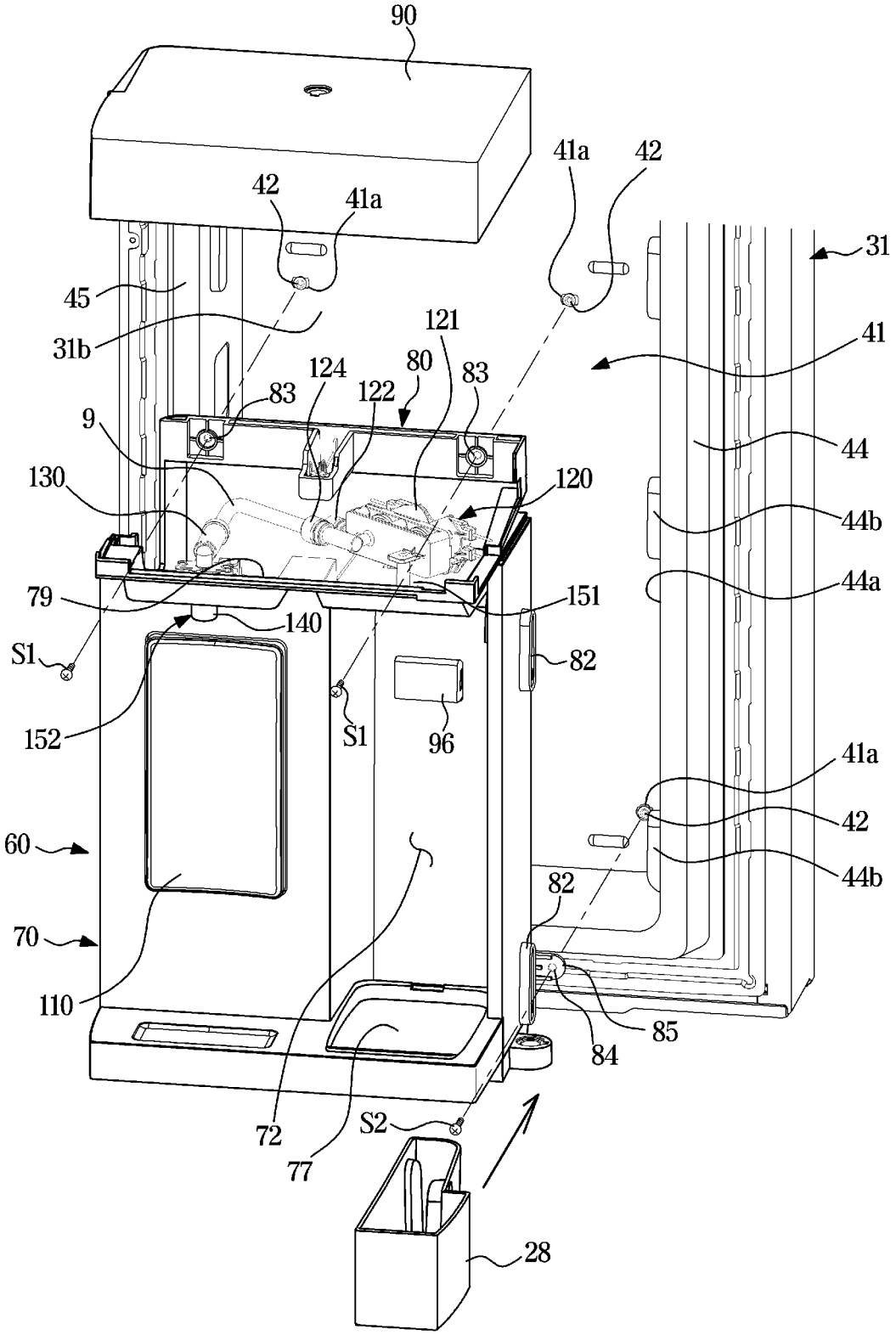
FIG. 7 shows coupling structures of a door and a water supply device according to an embodiment of the present disclosure.
Figure 8:
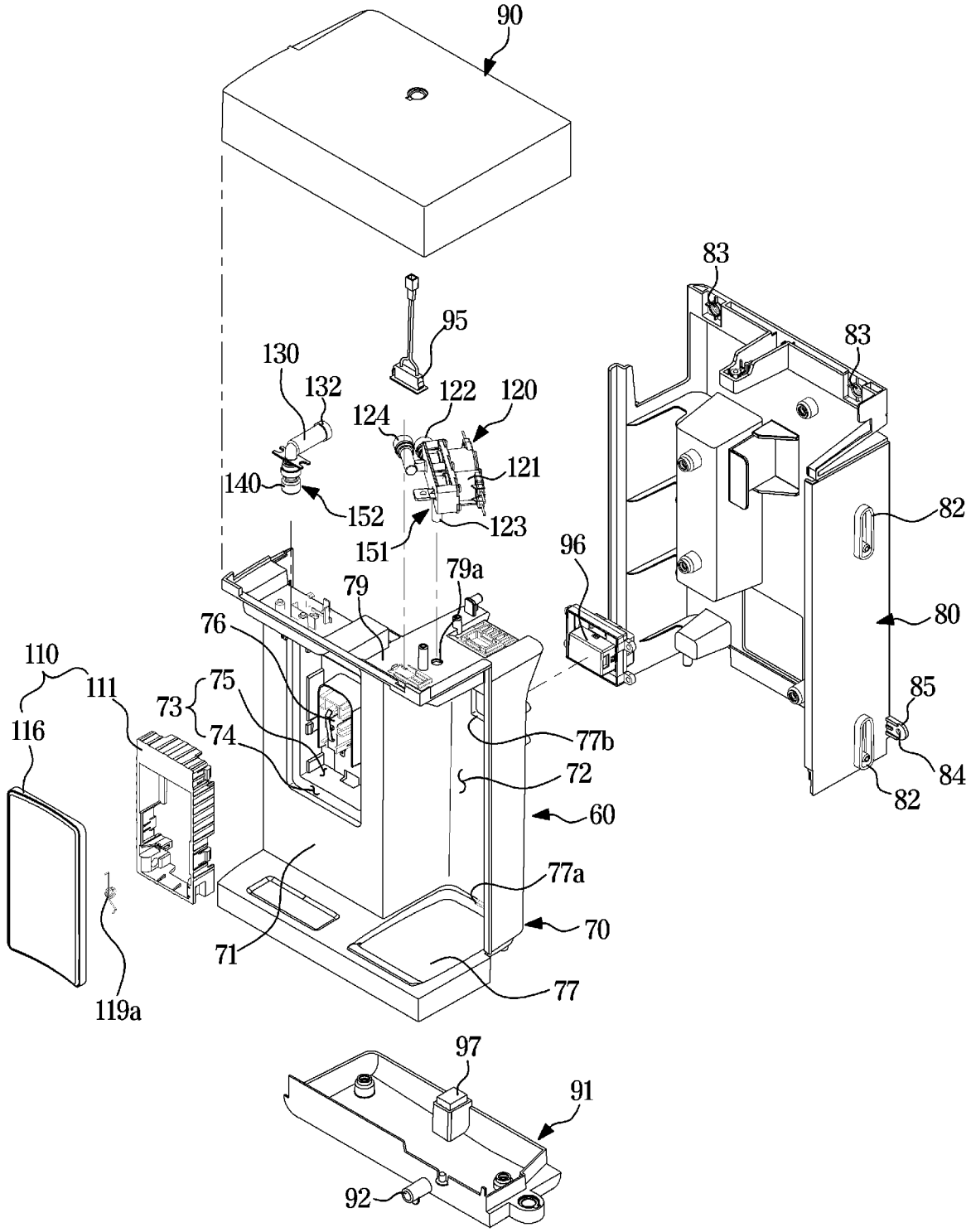
FIG. 8 shows a disassembled state of a water supply device according to an embodiment of the present disclosure.
Figure 9:
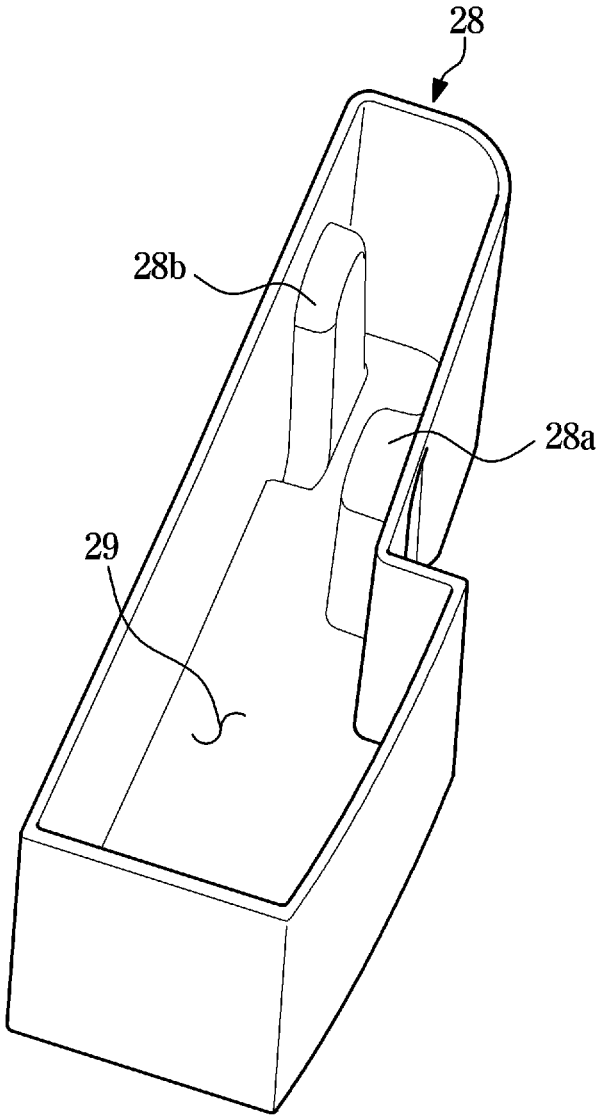
FIG. 9 shows a door basket according to an embodiment of the present disclosure.
Figure 10:
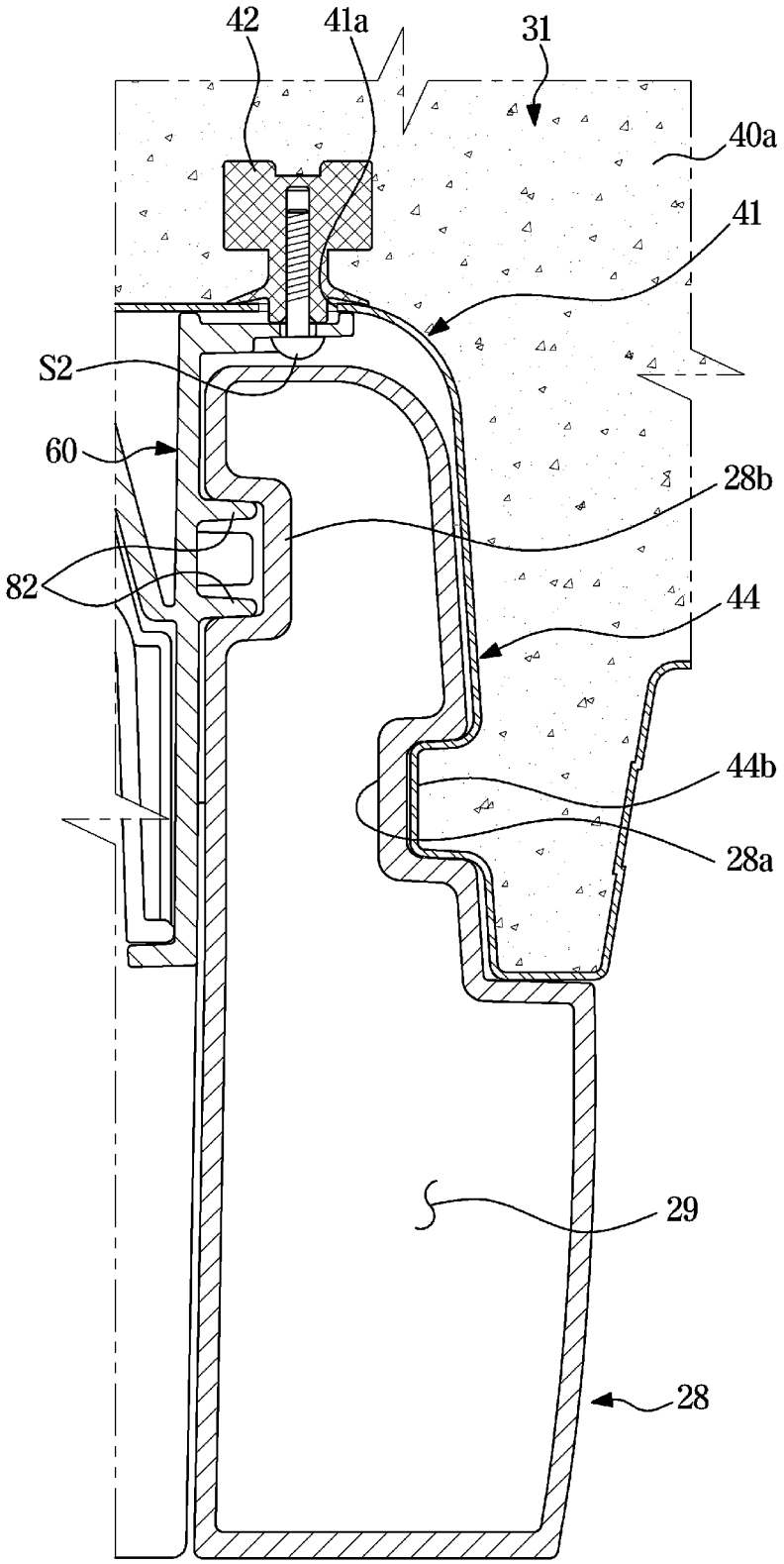
FIG. 10 shows a cross section of a coupling structure of a door basket according to an embodiment of the present disclosure.

FIG. 5 shows a disassembled state of a door and a water supply device according to an embodiment of the present disclosure. FIG. 6 shows a side of a water supply device according to an embodiment of the present disclosure. FIG. 7 shows coupling structures of a door and a water supply device according to an embodiment of the present disclosure. FIG. 8 shows a disassembled state of a water supply device according to an embodiment of the present disclosure. FIG. 9 shows a door basket according to an embodiment of the present disclosure. FIG. 10 shows a cross section of a coupling structure of a door basket according to an embodiment of the present disclosure.

Hereinafter, a structure of the door 31 will be described, and the structure of the door 31 will be applied in the same way to the other doors 32, 33, and 34.

Referring to FIGS. 5 to 10, the door 31 may include a door outer plate 40 and a door inner plate 41 coupled to a rear side of the door outer plate 40. An insulation 40*a* (see FIG. 10) may be provided between the door outer plate 40 and the door inner plate 41.

The door outer plate 40 may form the front surface 31*a* of the door 31. The door inner plate 41 may form the rear surface 31*b* of the door 31. An upper cap 48 may be coupled to upper ends of the door outer plate 40 and the door inner plate 41, and a lower cap 49 may be coupled to lower ends of the door outer plate 40 and the door inner plate 41. The door 31 may be rotatable about the rotation axis R.

The door 31 may include a pair of vertical dykes 44 and 45 protruding in a rear direction. The pair of vertical dykes 44 and 45 may be spaced from each other. The pair of vertical dykes 44 and 45 may protrude in the rear direction of the door 31 such that the door baskets 27 and 28 and the water supply device 50 are installed in the door 31. Each of the vertical dykes 44 and 45 may extend in an up-down direction.

The pair of vertical dykes 44 and 45 may include a first vertical dyke 44 formed on one side of the door 31, the one side being close to the rotation axis R of the door 31, and a second vertical dyke 45 opposite to the first vertical dyke 44. That is, the first vertical dyke 44 may be closer to the rotation axis R of the door 31 than the second vertical dyke 45, and in other words, the second vertical dyke 45 may be farther from the rotation axis R of the door 31 than the first vertical dyke 44.

The first vertical dyke 44 may include a dyke bead 44*b* protruding from an inner side surface 44*a* of the first vertical dyke 44. The second vertical dyke 45 may include a dyke bead 45*b* protruding from an inner side surface 45*a* of the second vertical dyke 45. One or more the dyke bead 44*b* may be provided, and one or more of the dyke bead 45*b* may be provided.

The water supply device 50 may be provided on the rear surface 31*b* of the upper left door 31. The water supply device 50 may be positioned in a space between the first vertical dyke 44 and the second vertical dyke 45.

More specifically, the water supply device 50 may be coupled to the second vertical dyke 45 that is relatively distant from the rotation axis R of the door 31. The water supply device 50 may be spaced from the first vertical dyke 44 that is relatively close to the rotation axis R of the door 31. Accordingly, a space may be formed between the water supply device 50 and the first vertical dyke 44. As such, because the water supply device 50 is distant from the rotation axis R of the door 31, the user may operate the lever 110 of the water supply device 50 more conveniently at a location that is distant from the main body 10.

However, unlike the current embodiment, the water supply device 50 may be coupled to the first vertical dyke 44, and spaced from the second vertical dyke 45. Alternatively, the water supply device 50 may be coupled to both the first vertical dyke 44 and the second vertical dyke 45.

One or more of the door basket 28 may be positioned in the space formed between the water supply device 50 and the first vertical dyke 44. The one or more the door basket 28 may include a goods space 29 (see FIG. 9) in which goods may be accommodated. Accordingly, an entire storage space of the refrigerator 1 may increase.

The water supply device 50 may include the water supply case 60. The bucket installation space 72 in which the water bucket 51 may be installed may be formed in the water supply case 60. Various kinds of sensors 95, 96, and 97 may be installed in the water supply case 60. The first water supply port 151 and the second water supply port 152 may be provided in the water supply case 60. The lever 110 may be provided in the water supply case 60. Accordingly, the water supply device 50 may be integrated into one body through the water supply case 60.

The water supply case 60 may be detachably installed in the door 31. The water supply case 60 may be coupled to the second vertical dyke 45. In one surface of the water supply case 60, a case bead groove 81 (see FIG. 6) that is coupled to the dyke bead 45*b* of the second vertical dyke 45 may be formed. The dyke bead 45*b* of the second vertical dyke 45 may be inserted into the case bead groove 81 of the water supply case 60 from bottom to top. That is, the water supply case 60 may be coupled to the second vertical dyke 45 from top to bottom. By inserting the dyke bead 45*b* into the case bead groove 81, the water supply case 60 may be temporarily fixed to the door 31.

The water supply case 60 may be coupled to the rear surface 31*b* of the door 31 through a coupling member S1 and a coupling member S2 (also referred to as couplings). That is, in a state in which the dyke bead 45*b* is inserted into the case bead groove 81 and the water supply case 60 is temporarily fixed to the door 31, the coupling member S1 and the coupling member S2 may firmly fix the water supply case 60 to the rear surface 31*b* of the door 31.

To this end, coupling holes 83 and 84 to which the coupling member S1 and the coupling member S2 are coupled may be formed in the water supply case 60. One or more of the coupling hole 83 and one or more of the coupling hole 84 may be provided. For example, two of the coupling hole 83 may be formed in an upper portion of the water supply case 60, and one of the coupling hole 84 may be formed in a lower portion of the water supply case 60. However, a number and positions of the coupling hole 83 and the coupling hole 84 are not limited. The water supply case 60 may include a coupling protrusion 85 in which the coupling hole 84 is formed.

In the door inner plate 41, an inner plate hole 41*a* penetrating the door inner plate 41 may be formed. A grommet 42 (see FIG. 10) may be coupled to the inner plate hole 41*a*. The grommet 42 may be coupled to the inner plate hole 41*a* to prevent the insulation 40*a* positioned between the door outer plate 40 and the door inner plate 41 from leaking to the outside of the upper left door 31 through the inner plate hole 41*a*. The grommet 42 inserted in the inner plate hole 41*a* may be supported by the insulation 40*a*.

The grommet 42 may include a coupling hole which the coupling member S1 and the coupling member S2 are inserted in and coupled to. The coupling member S1 and the coupling member S2 may be coupled to the grommet 42 by penetrating the coupling hole 83 and the coupling hole 84 of the water supply case 60. By the structure, the coupling member S1 and the coupling member S2 may firmly couple the water supply case 60 to the rear surface 31*b* of the upper left door 31.

The water supply case 60 may include a case bead 82 which is formed at one surface of the water supply case 60 and to which the door basket 28 is coupled.

The door basket 28 may include a first basket bead groove 28*a* formed at one surface of the door basket 28 and coupled to the dyke bead 44*b* of the first vertical dyke 44, and a second basket bead groove 28*b* formed at an opposite surface of the door basket 28 and coupled to the case bead 82 of the water supply case 60 (see FIG. 10).

The dyke bead 44*b* of the first vertical dyke 44 may be inserted into the first basket bead groove 28*a* of the door basket 28 from bottom to top. The case bead 82 of the water supply case 60 may be inserted into the second basket bead groove 28*b* of the door basket 28 from bottom to top. By the structure, the door basket 28 may be easily installed or detached between the water supply case 60 and the first vertical dyke 44.

The first basket bead groove 28*a* and the second basket bead groove 28*b* may be convex toward the goods space 29. The first basket bead groove 28*a* may be non-aligned with the second basket bead groove 28*b*. That is, the first basket bead groove 28*a* may be spaced from the second basket bead groove 28*b* in front-rear and left-right directions. Due to the structure, goods having a larger size may be stored in the goods space 29.

Upon installation of the door basket 28 between the water supply case 60 and the first vertical dyke 44, the door basket 28 may cover the coupling member S2. That is, the door basket 28 may prevent the coupling member S2 from being exposed.

As shown in FIGS. 7 and 8, the water supply case 60 may include a case body 70, a case bracket 80 for coupling the case body 70 to the door 31, a case cover 90 coupled to the case body 70 and covering an upper portion of the case body 70, and a tray 91 coupled to a lower portion of the case body 70 to collect water discharged from the water bucket 51.

However, according to embodiments, at least one from among the case body 70, the case bracket 80, the case cover 90, and the tray 91 may be omitted. Also, according to embodiments, two or more of the case body 70, the case bracket 80, the case cover 90, and the tray 91 may be integrated into one body.

At one side of a front surface 71 of the case body 70, the bucket installation space 72 may be formed by being recessed. At another side of the front surface 71 of the case body 70, the lever 110 may be installed. At the other side of the front surface 71 of the case body 70, a lever accommodating groove 73 in which at least one portion of the lever 110 is accommodated may be formed.

At least one portion of the water bucket 51 may be accommodated in the bucket installation space 72. The case body 70 may include a bucket support portion 77 provided at a lower area of the bucket installation space 72 and supporting a lower end of the water bucket 51. At the bucket support portion 77, an overflow hole 77*a* for guiding water overflowing from the water bucket 51 to the tray 91 may be formed.

The water level sensor 96 may be installed in the case body 70. The water level sensor 96 may be a capacitive sensor capable of detecting a water level of the water bucket 51 by detecting capacitance changing according to a level of liquid stored in the water bucket 51. Accordingly, the water level sensor 96 may detect a water level of the water bucket 51 without being in direct contact with liquid stored in the water bucket 51. The water level sensor 96 is not limited to the capacitive sensor, and may include various kinds of water level sensors capable of detecting a water level of the water bucket 51.

The case body 70 may include a water level sensor installing opening 77*b* at which the water level sensor 96 may be installed. The water level sensor 96 may be installed on a rear surface of the case body 70 by penetrating the water level sensor installing opening 77*b* to be in contact with the water bucket 51. However, a position of the water level sensor 96 is not limited to the rear surface of the case body 70, and the water level sensor 96 may be installed at another position at which the water level sensor 96 may be in contact with the water bucket 51.

A bucket installation sensor 95 may be installed in the case body 70. The bucket installation sensor 95 may detect installation of the water bucket 51 in the bucket installation space 72. The bucket installation sensor 95 may be a hall sensor. The bucket installation sensor 95 may detect a magnet 56 (see FIG. 11) included in the water bucket 51. The bucket installation sensor 95 may be coupled to an upper surface 79 of the case body 70.

However, the bucket installation sensor 95 is not limited to a hall sensor, and may be a mechanical sensor that detects installation of the water bucket 51 by contacting the water bucket 51. Also, a position of the bucket installation sensor 95 is not limited to the upper surface 79 of the case body 70, and the bucket installation sensor 95 may be provided at a lower or side surface of the case body 70.

The switching valve 120 may be installed at the case body 70. The switching valve 120 may be coupled to the upper surface 79 of the case body 70. As described above, the switching valve 120 may supply water supplied through the water supply flow path 7 selectively to any one of the first water supply port 151 or the second water supply port 152.

The switching valve 120 may be a 3-way valve. The switching valve 120 may include a valve body 121 in which a flow path is formed, an inlet port 122 through which water enters the valve body 121, and a plurality of outlet ports 123 and 124 through which water is discharged from the valve body 121. The inlet port 122 may be connected to the water supply flow path 7 to receive water. A first outlet port 123 may supply water to the water bucket 51.

The first water supply port 151 of the water supply device 50 may include the first outlet port 123. That is, the first outlet port 123 of the switching valve 120 may not be connected to a hose, a nozzle, etc., and the first outlet port 123 may itself be the first water supply port 151. The first outlet port 123 may protrude downward from the valve body 121. However, unlike the current embodiment, the first water supply port 151 may be configured as a separate nozzle, instead of the first outlet port 123, and the separate nozzle may be connected to the first outlet port 123 of the switching valve 120 through a water supply hose, etc.

In the upper surface 79 of the case body 70, a first through hole 79*a* which the first outlet port 123 penetrates may be formed. Water discharged through the first outlet port 123 may fall to an inlet 55 of the water bucket 51.

The water supply hose 9 may be connected to the second outlet port 124 of the switching valve 120. One end of the water supply hose 9 may be connected to the second outlet port 124, and another end of the water supply hose 9 may be connected to a connection tube 130.

A water cork 140 may be detachably coupled to the connection tube 130. The second water supply port 152 may include the water cork 140. As such, because the water cork 140 is detachably coupled to the connection tube 130, it may be possible to detach, upon contamination of the water cork 140, the water cork 140 from the connection tube 130 and wash the water cork 140.

While water is filled in a container by a manual operation of the lever 110, the water cork 140 may be contaminated due to water splashed from the container shaking. In this case, it may be possible to detach the water cork 140 from the connection tube 130, wash the water cork 140, and then install the water cork 140 in the connection tube 130. The connection tube 130 may be coupled to the upper surface 79 of the case body 70. In the upper surface 79 of the case body 70, a first through hole 79*b* (see FIG. 18) which the water cork 140 penetrates may be formed.

The lever 110 may be installed on the front surface 71 of the case body 70. The lever accommodating groove 73 may be recessed in the front surface 71 of the case body 70 to install the lever 110 thereon. In the lever accommodating groove 73, a switch 76 that is pressed by the lever 110 to generate an electrical signal may be provided.

The lever 110 may include a lever frame 111 coupled to the lever accommodating groove 73, and a lever body 116 rotatably coupled to the lever frame 111 to press the switch 76. A user may press the lever body 116 with his/her hand or a container, such as a cup, a bowl, a bottle, etc. The lever 110 may include an elastic member 119*a* elastically supporting the lever body 116.

The lever accommodating groove 73 may include a first lever accommodating groove 74, and a second lever accommodating groove 75 formed inside the first lever accommodating groove 74 in such a way as to have a step with the first lever accommodating groove 74. Detailed structures of the lever 110 and the lever accommodating groove 73 will be described below.

The water supply case 60 may include a case bracket 80 for coupling the case body 70 to the door 31. The case bracket 80 may be coupled to a rear side of the case body 70. The case bracket 80 may be coupled to the door 31 in a state of being coupled to the case body 70.

In one surface of the case bracket 80, the case bead groove 81 may be formed to be coupled to the second vertical dyke 45. In an opposite surface of the case bracket 80, the case bead 82 may be formed to be coupled to the door basket 28. In an upper portion of the case bracket 80, the coupling hole 83 to which the coupling member S1 is coupled may be formed. In a lower portion of the case bracket 80, the coupling hole 84 to which the coupling member S2 is coupled may be formed. The coupling protrusion 85 having the coupling hole 84 may protrude from the lower portion of the case bracket 80 in a side direction.

The water level sensor 96 may be positioned between the case body 70 and the case bracket 80.

The case cover 90 may be coupled to the upper surface 79 of the case body 70. The case cover 90 may cover various components mounted on the upper surface 79 of the case body 70 to prevent the components from being exposed to the outside. That is, the case cover 90 may cover the bucket installation sensor 95, the switching valve 120, the connection tube 130, etc. mounted on the upper surface of the case body 70 to prevent the bucket installation sensor 95, the switching valve 120, the connection tube 130, etc. from being exposed. Also, the case cover 90 may cover the coupling hole 83 formed in the upper portion of the case bracket 80 to prevent the coupling hole 83 from being exposed to the outside.

The tray 91 may be coupled to the lower portion of the case body 70. Water overflowing from the water bucket 51 may be collected in the tray 91 through the overflow hole 77*a*. In the tray 91, a drain 92 for draining water collected in the tray 91 may be provided. A plug (not shown) may be coupled to the drain 92, and by separating the plug from the drain 92, water collected in the tray 91 may be drained. An overflow sensor 97 for detecting water collected in the tray 91 may be provided in the tray 91.

Figure 11:
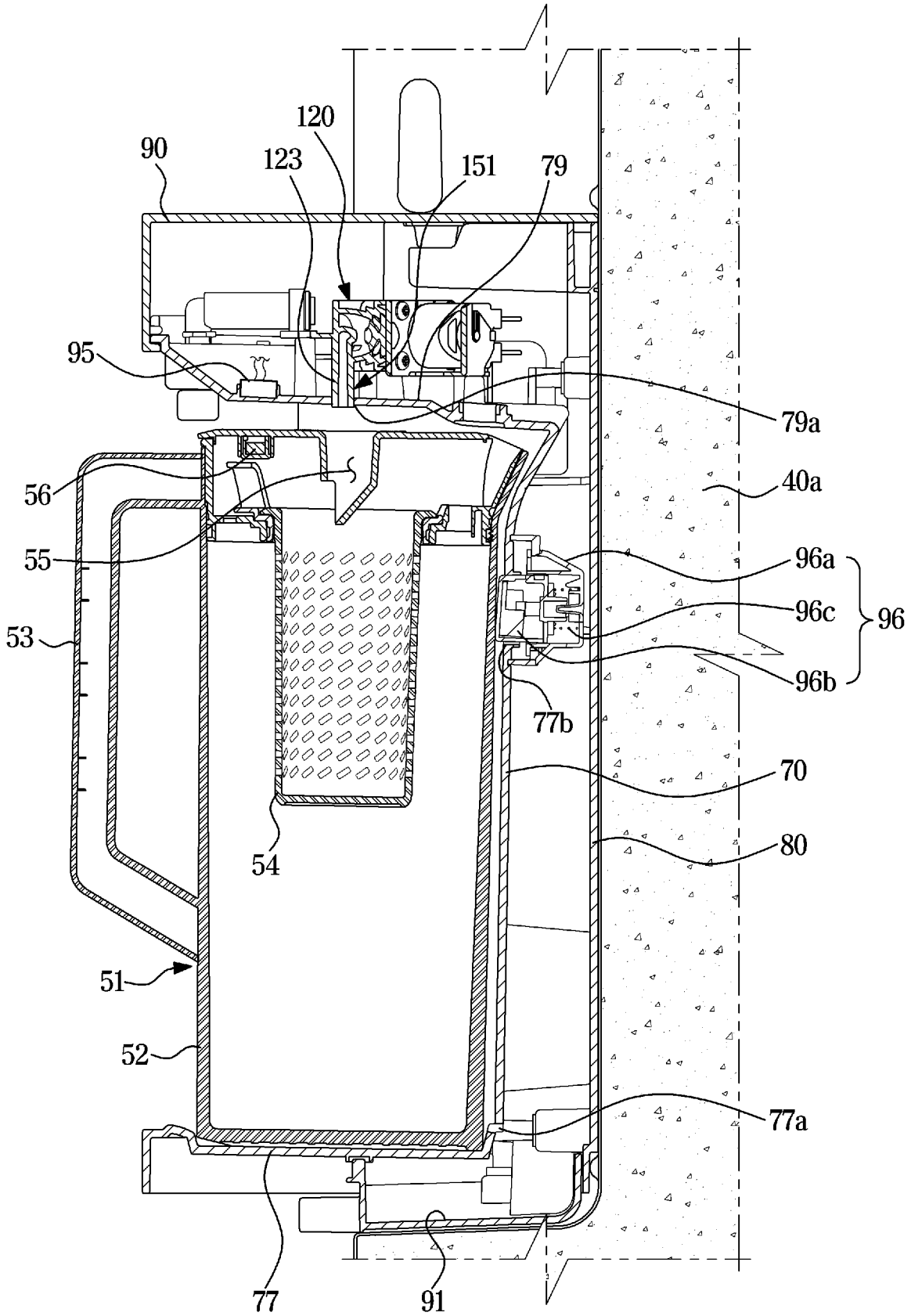
FIG. 11 shows a cross section of an installation structure of a water bucket according to an embodiment of the present disclosure.

FIG. 11 shows a cross section of an installation structure of a water bucket according to an embodiment of the present disclosure.

Referring to FIG. 11, the water bucket 51 may include a bucket body 52 that accommodates water therein. A handle 53 may be formed in the bucket body 52. An inlet 55 through which water falling from the first water supply port 151 enters inside of the bucket body 52 may be formed in an upper portion of the bucket body 52. The water bucket 51 may include a magnet 56 that may be detected by the bucket installation sensor 95. In the water bucket 51, an infuser 54 where a tea bag or the like may be put may be provided.

Upon installation of the water bucket 51 in the bucket installation space 72, the lower end of the water bucket 51 may be supported by the bucket support portion 77. Upon installation of the water bucket 51 in the bucket installation space 72, the water bucket 51 may contact the water level sensor 96. The water level sensor 96 may include a sensor bracket 96*a* fixed to the case body 70 of the water supply case 60, a sensor portion 96*b* for detecting a water level of the water bucket 51, and an elastic member 96*c* for pressing the sensor portion 96*b* toward the water bucket 51 to cause the sensor portion 96*b* to be in close contact with the water bucket 51.

Figure 12:
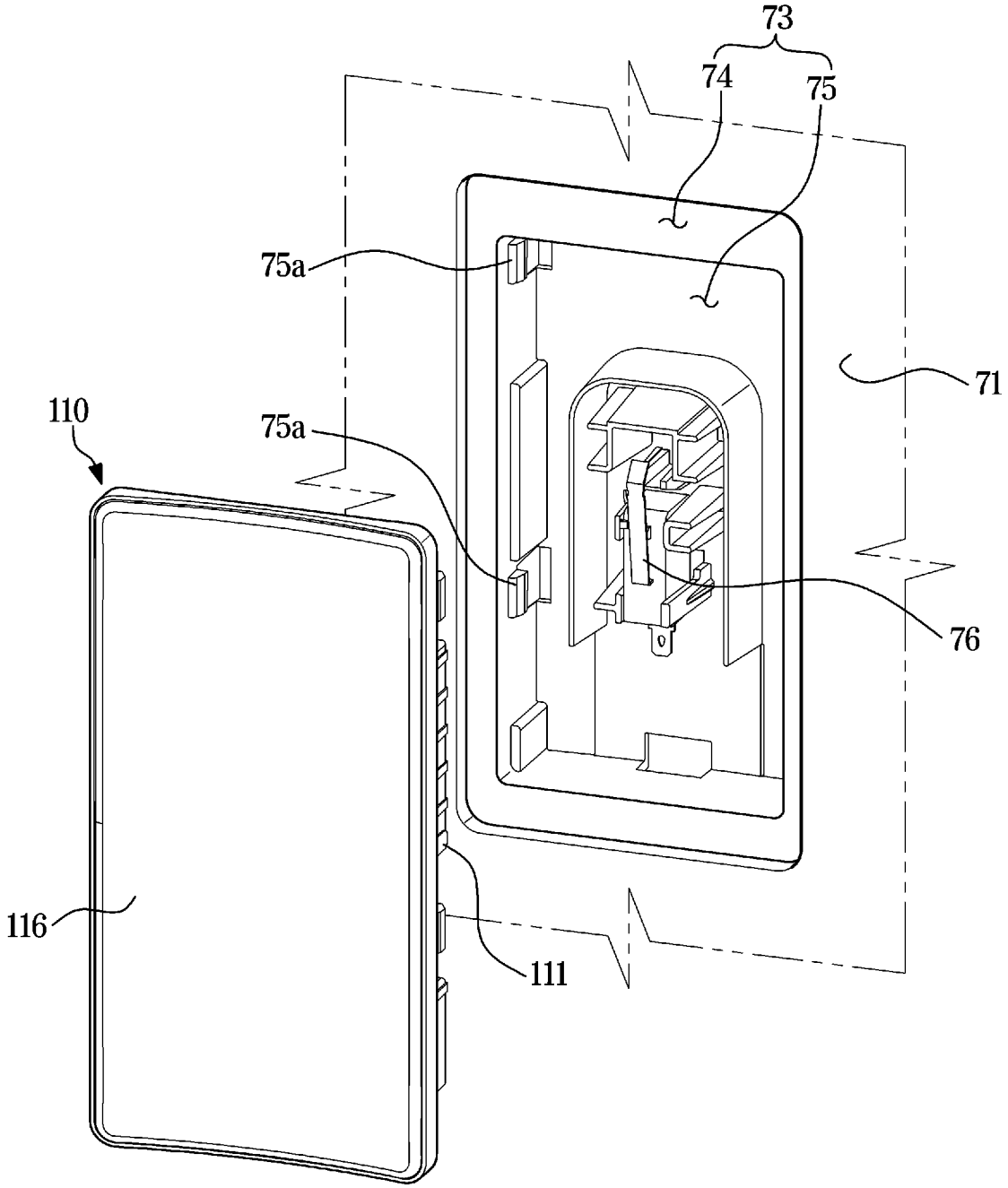
FIG. 12 shows a state in which a lever is separated from a water supply case according to an embodiment of the present disclosure.
Figure 13:
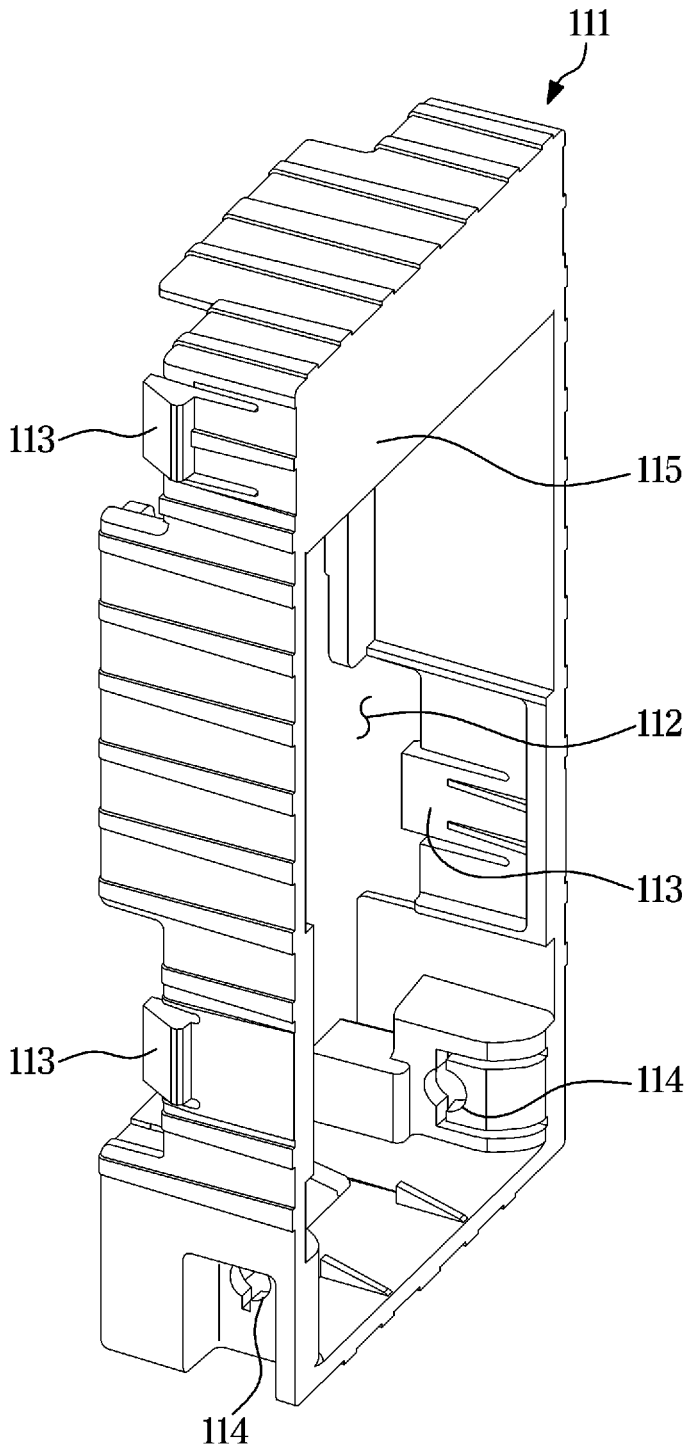
FIG. 13 shows a lever frame according to an embodiment of the present disclosure.
Figure 14:
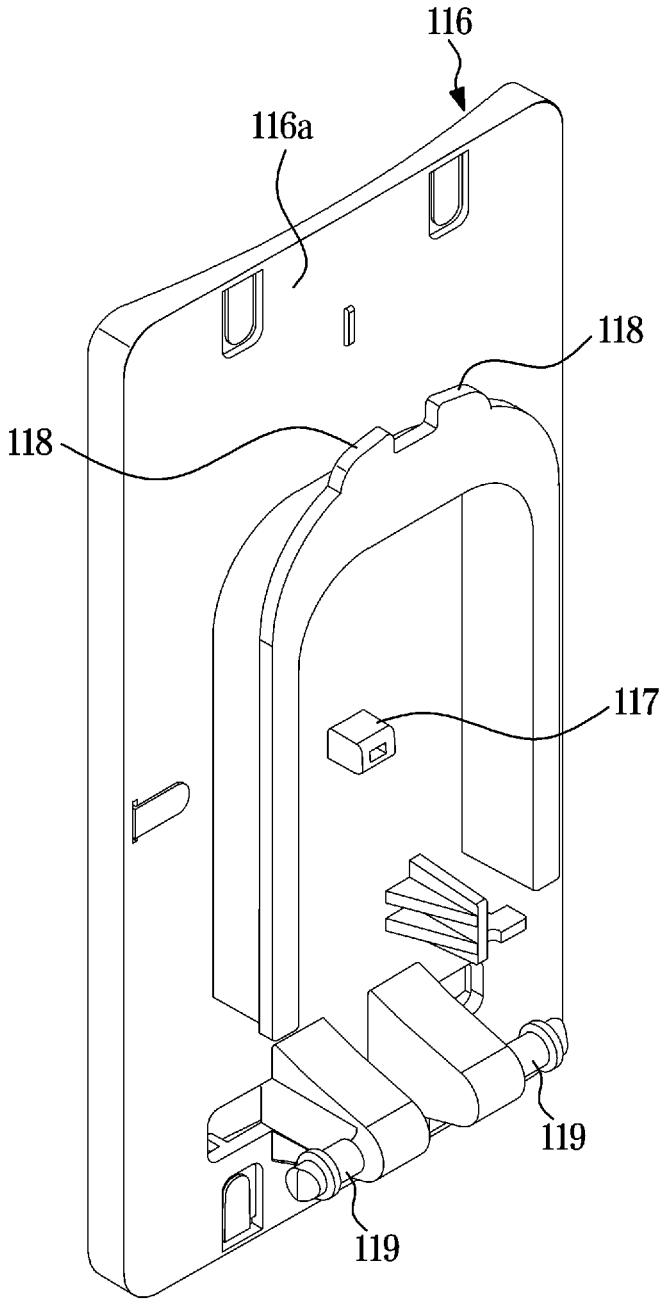
FIG. 14 shows a lever body according to an embodiment of the present disclosure.
Figure 15:
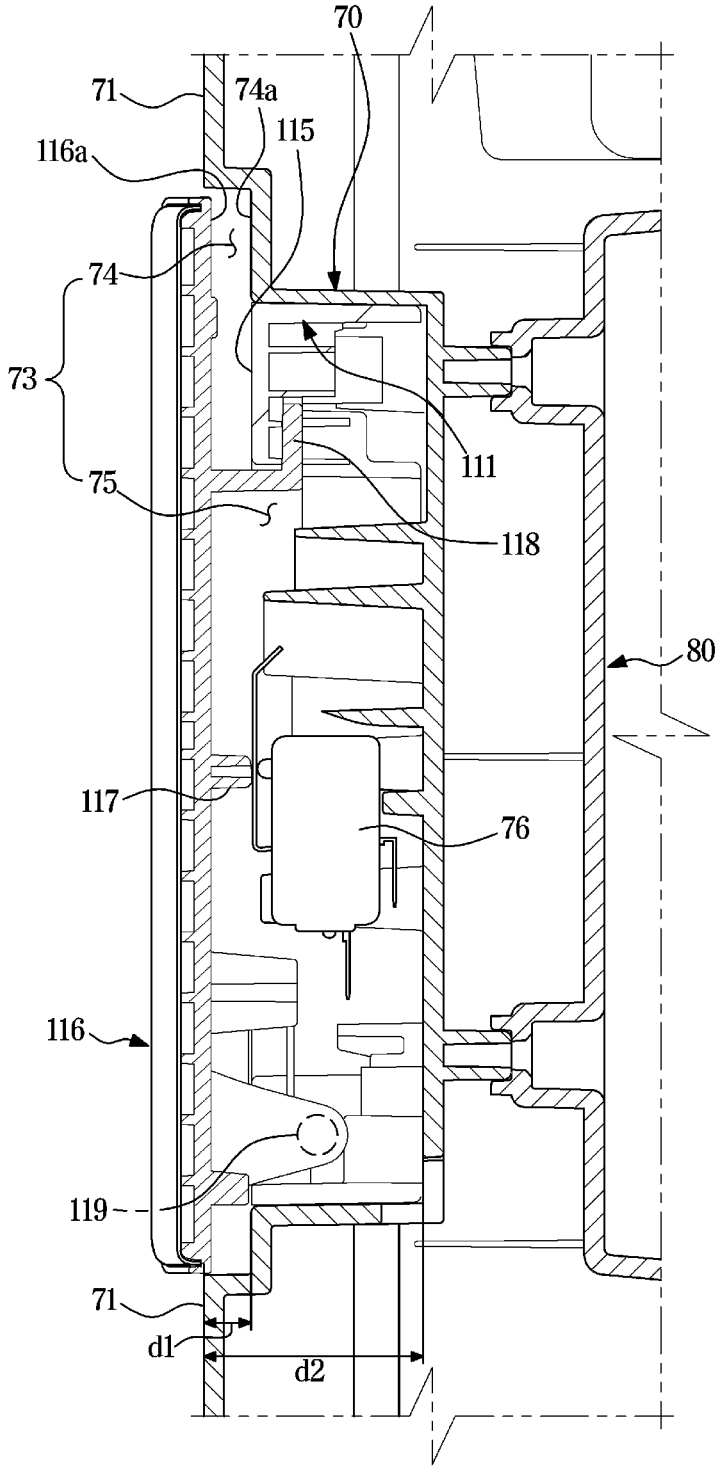
FIG. 15 shows an installation structure of a lever according to an embodiment of the present disclosure.
Figure 16:
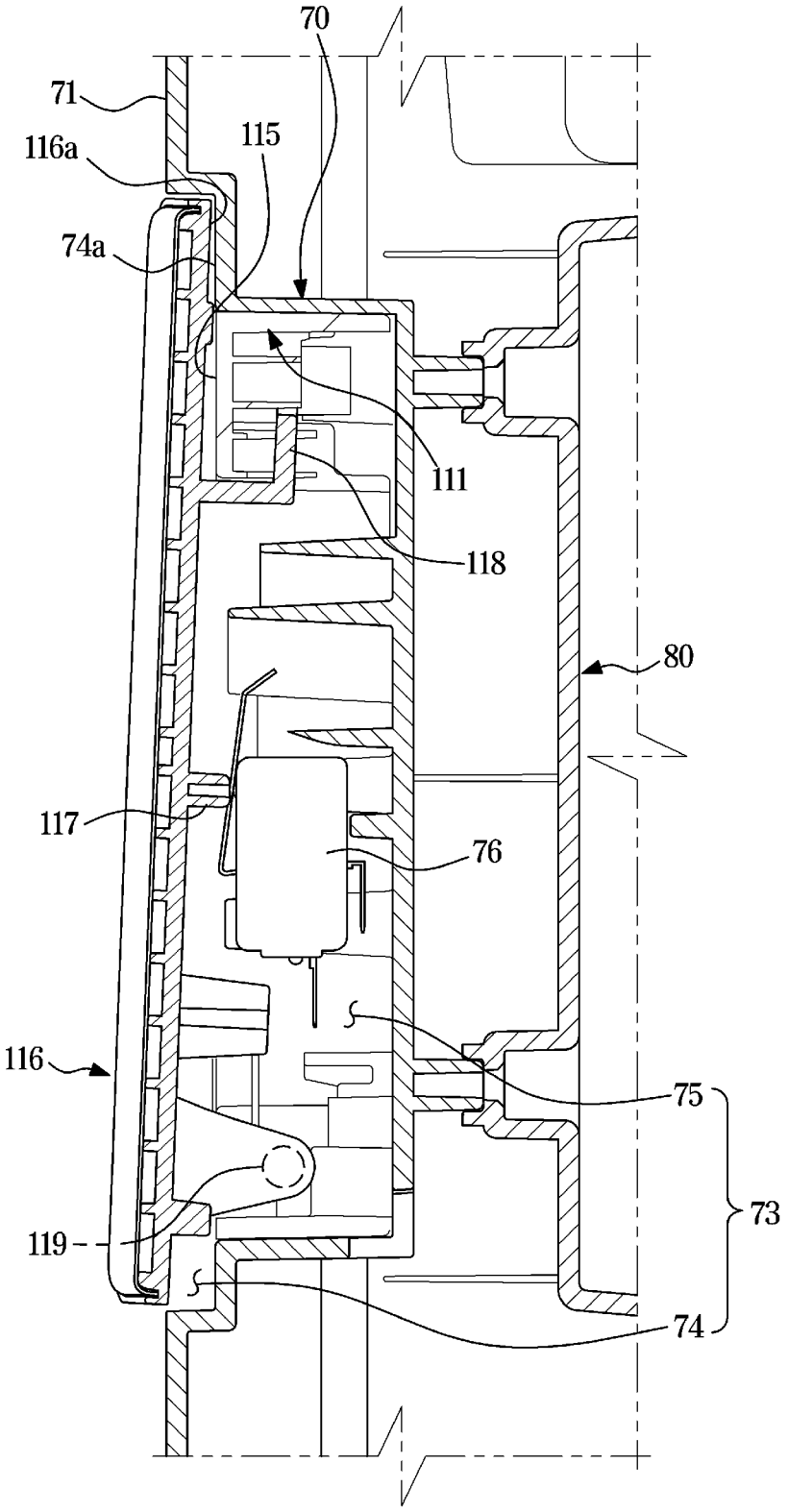
FIG. 16 shows a pressed state of a lever according to an embodiment of the present disclosure.

FIG. 12 shows a state in which a lever is separated from a water supply case according to an embodiment of the present disclosure. FIG. 13 shows a lever frame according to an embodiment of the present disclosure. FIG. 14 shows a lever body according to an embodiment of the present disclosure. FIG. 15 shows an installation structure of a lever according to an embodiment of the present disclosure. FIG. 16 shows a pressed state of a lever according to an embodiment of the present disclosure.

Referring to FIGS. 12 to 16, the lever accommodating groove 73, recessed to install the lever 110 thereon, may be formed in the front surface 71 of the case body 70 of the water supply case 60. The switch 76 may be positioned in the lever accommodating groove 73.

The lever accommodating groove 73 may include the first lever accommodating groove 74, and the second lever accommodating groove 75 formed inside the first lever accommodating groove 74 in such a way as to have a step with the first lever accommodating groove 74. A depth d2 of the second lever accommodating groove 75 from the front surface 71 of the case body 70 may be greater than a depth d1 of the first lever accommodating groove 74 from the front surface 71 of the case body 70 (see FIG. 15).

The lever 110 may include the lever frame 111 coupled to the lever accommodating groove 73 of the water supply case 60. The lever frame 111 may be in a shape of a frame having a frame opening 112 in the center portion. A pusher 117 of the lever body 116 may press the switch 76 through the frame opening 112. The lever frame 111 may include a rotating shaft coupling portion 114 rotatably supporting a lever rotating shaft 119 of the lever body 116.

The lever frame 111 may include at least one coupling protrusion 113, and the at least one coupling protrusion 113 may be coupled to at least one hook protrusion 75*a* formed in the lever accommodating groove 73. Upon installation of the lever frame 111 in the lever accommodating groove 73, an outer side surface of the lever frame 111 may be supported by an inner side surface of the lever accommodating groove 73. Upper, lower, left, and right outer side surfaces of the lever frame 111 may be supported by upper, lower, left, and right outer side surfaces of the lever accommodating groove 73.

As such, because the at least one coupling protrusion 113 of the lever frame 111 is coupled to the at least one hook protrusion 75*a* of the lever accommodating groove 73 and the outer side surface of the lever frame 111 is supported by the inner side surface of the lever accommodating groove 73, the lever frame 111 may be stably coupled to the lever accommodating groove 73.

The lever frame 111 may be accommodated in the second lever accommodating groove 75 of the lever accommodating groove 73.

The lever body 116 may be rotatatably coupled to the lever frame 111. The lever body 116 may include the lever rotating shaft 119 rotatably coupled to the rotating shaft coupling portion 114 of the lever frame 111. The elastic member 119*a* (see FIG. 8) may be coupled to the lever rotating shaft 119 of the lever body 116, and the elastic member 119*a* may elastically support the lever body 116.

For example, the elastic member 119*a* may elastically bias the lever body 116 to rotate the lever body 116 in a direction in which an upper end of the lever body 116 escapes from the lever accommodating groove 73. The lever body 116 may include a stopper 118 for limiting a rotation range of the lever body 116. The stopper 118 of the lever body 116 may be supported by a trapping portion 115 of the lever frame 111 to limit the rotation range of the lever body 116.

On a rear surface 116*a* of the lever body 116, the pusher 117 for pressing the switch 76 may protrude.

At least one portion of the lever body 116 may be accommodated in the first lever accommodating groove 74.

As shown in FIG. 15, while a user does not press the lever body 116, the rear surface 116*a* of the lever body 116 may be nearly parallel to the front surface 71 of the case body 70 and spaced from a bottom 74*a* of the first lever accommodating groove 74. Accordingly, a gap between the lever body 116 and the first lever accommodating groove 74 may be substantially covered by the lever body 116 such as to not to be exposed to the outside. Accordingly, an aesthetic sense may be improved and foreign materials may be prevented from entering the lever accommodating groove 73, resulting in an improvement of durability of the lever 110.

As shown in FIG. 16, while the user presses the lever body 116, the upper end of the lever body 116 may move toward the bottom 74*a* of the first lever accommodating groove 74, and a portion of the lever body 116 may be accommodated in the first lever accommodating groove 74.

Figure 17:
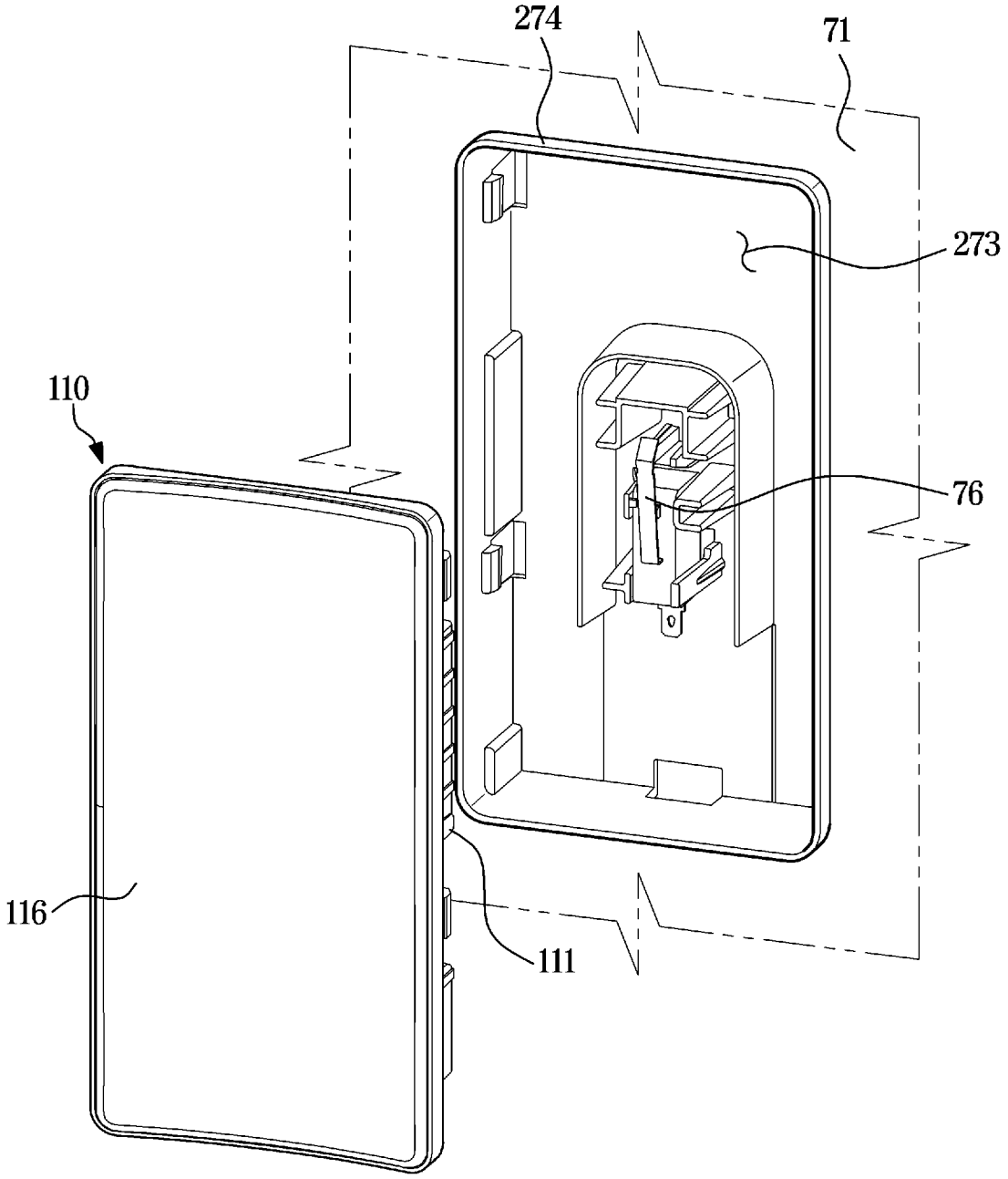
FIG. 17 shows a state in which a lever is separated from a water supply case according to an embodiment of the present disclosure.

FIG. 17 shows a state in which a lever is separated from a water supply case according to an embodiment of the present disclosure.

According to an embodiment of the present disclosure, in the front surface 71 of the case body 70 of the water supply case 60, a lever accommodating groove 273 may be formed to install the lever 110 thereon.

A cover rib 274 may protrude along borders of the lever accommodating groove 273 of the front surface 71 of the case body 70.

By the structure, a gap between the lever body 116 and the lever accommodating groove 273 may be substantially covered by the cover rib 274 such as not to be exposed to the outside. Accordingly, an aesthetic sense may be improved and foreign materials may be prevented from entering the lever accommodating groove 273, resulting in an improvement of durability of the lever 110.

Figure 18:
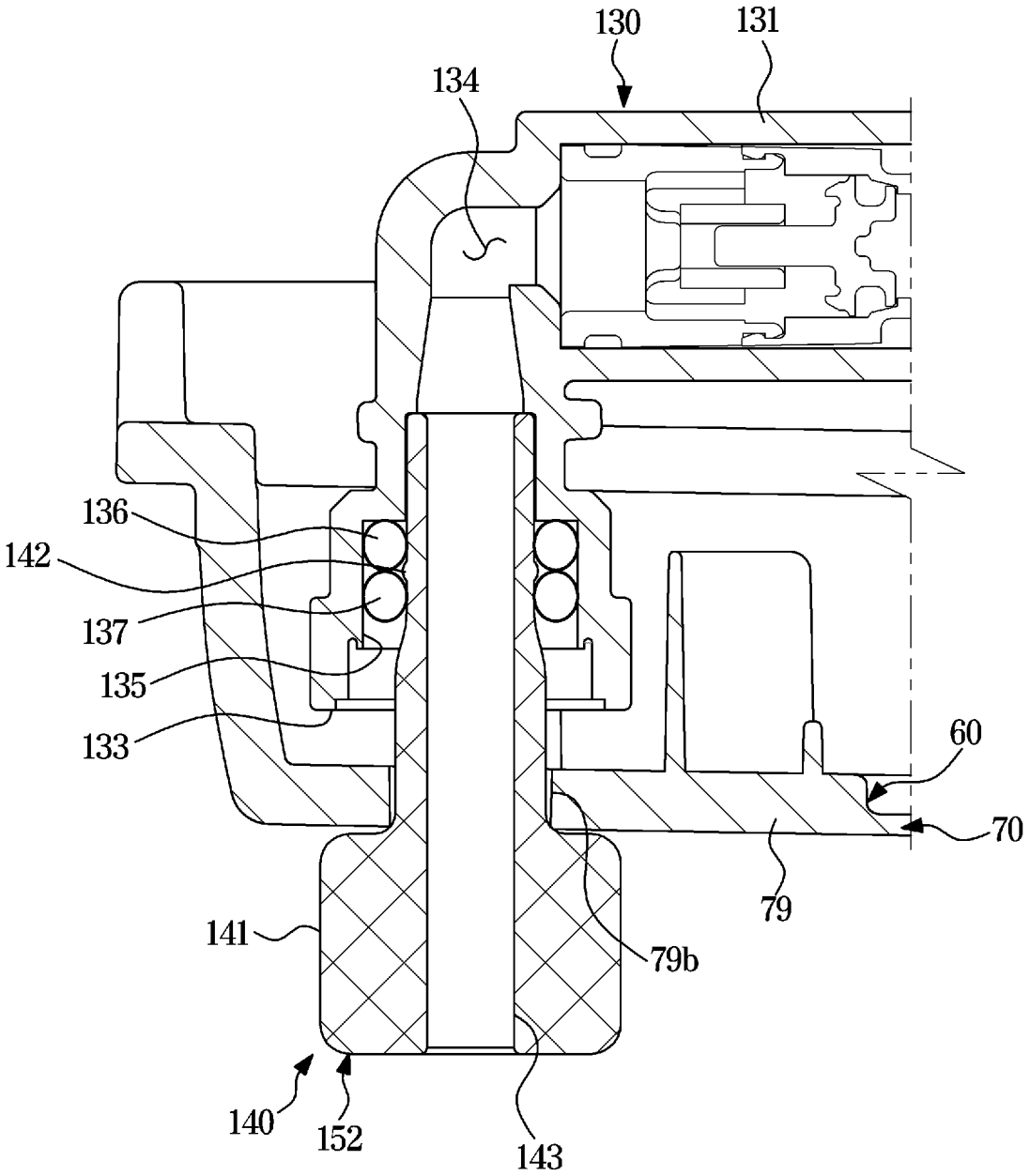
FIG. 18 shows a cross section of a coupling structure of a water cork according to an embodiment of the present disclosure.
Figure 19:
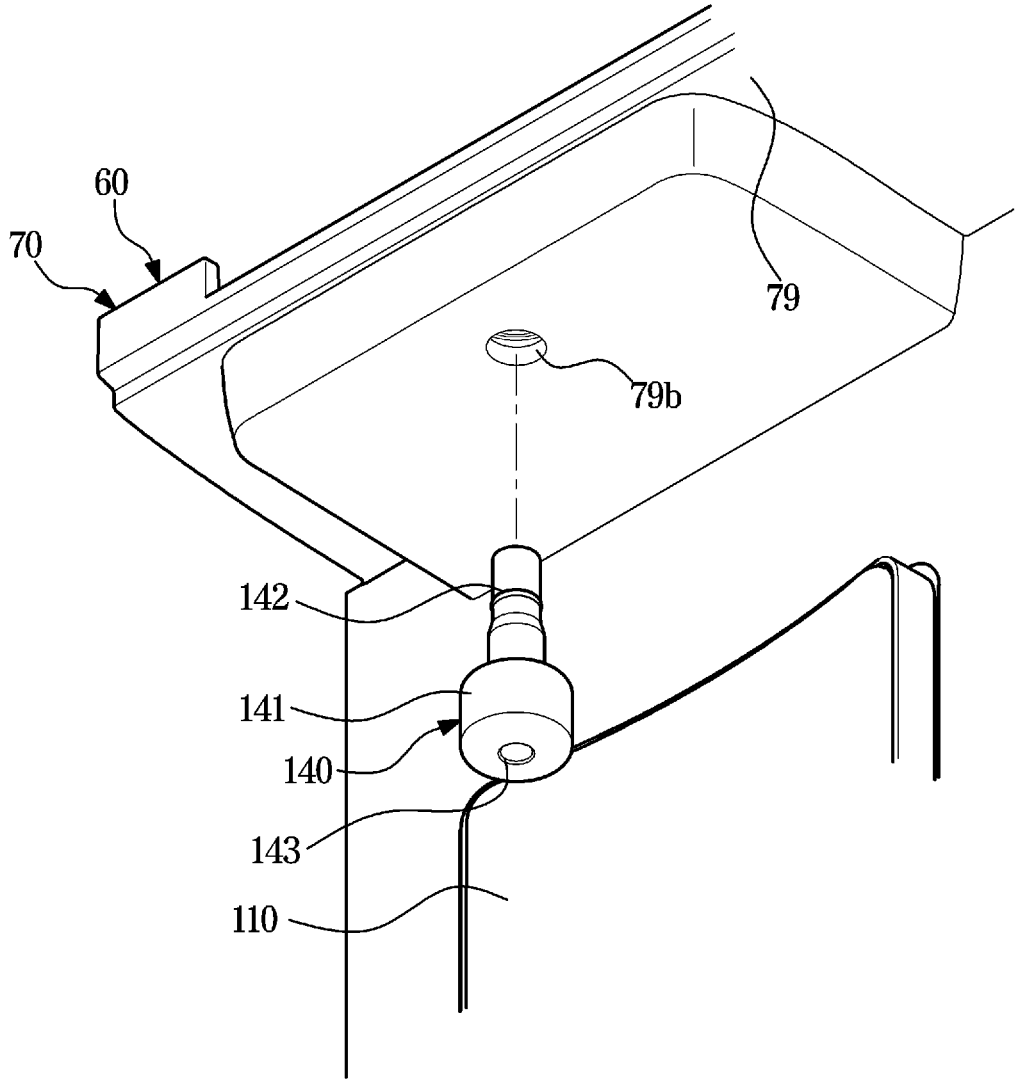
FIG. 19 shows a coupling structure of a water cork according to an embodiment of the present disclosure.

FIG. 18 shows a cross section of a coupling structure of a water cork according to an embodiment of the present disclosure. FIG. 19 shows a coupling structure of a water cork according to an embodiment of the present disclosure.

As shown in FIGS. 18 and 19, the water supply device 50 may include the connection tube 130 for detachably coupling the water cork 140 thereto. The connection tube 130 may include an inlet 132 (see FIG. 8) and an outlet 133, and the inlet 132 of the connection tube 130 may be connected to the water supply hose 9 (see FIG. 7) to receive water. The water cork 140 may be detachably coupled to the outlet 133 of the connection tube 130.

The connection tube 130 may include a connection tube body 131 having a tube internal space 134. The connection tube 130 may include a plurality of cork fixing rings 136 and 137 coupled to an inner circumferential surface 135 of the connection tube body 131 toward the outlet 133. Each of the plurality of cork fixing rings 136 and 137 may be an O-ring having elasticity. The plurality of cork fixing rings 136 and 137 may have the same shape and size. The plurality of cork fixing rings 136 and 137 may be adjacent to each other in the up-down direction.

The water cork 140 may include a water cork body 141 having an internal flow path 143, and a portion of the water cork body 141 may be inserted in the connection tube 130. The water cork 140 may include a protrusion ring 142 formed on an outer circumferential surface of the water cork body 141 to be sandwiched between the plurality of cork fixing rings.

During a process of inserting the water cork 140 into the connection tube 130, the lower cork fixing ring 137 may be elastically deformed and accordingly, the protrusion ring 142 may be installed between the plurality of cork fixing rings 136 and 137. After the protrusion ring 142 is installed between the plurality of cork fixing rings 136 and 137, the cork fixing ring 137 may return to the original state and support the protrusion ring 142 to prevent the water cork 140 from escaping from the connection tube 130.

By the structure, the water cork 140 may be easily coupled to the connection tube 130. Also, a coupling force between the water cork 140 and the connection tube 130 may be reinforced and the water cork 140 may be prevented from unintentionally escaping from the connection tube 130.

Figure 20:
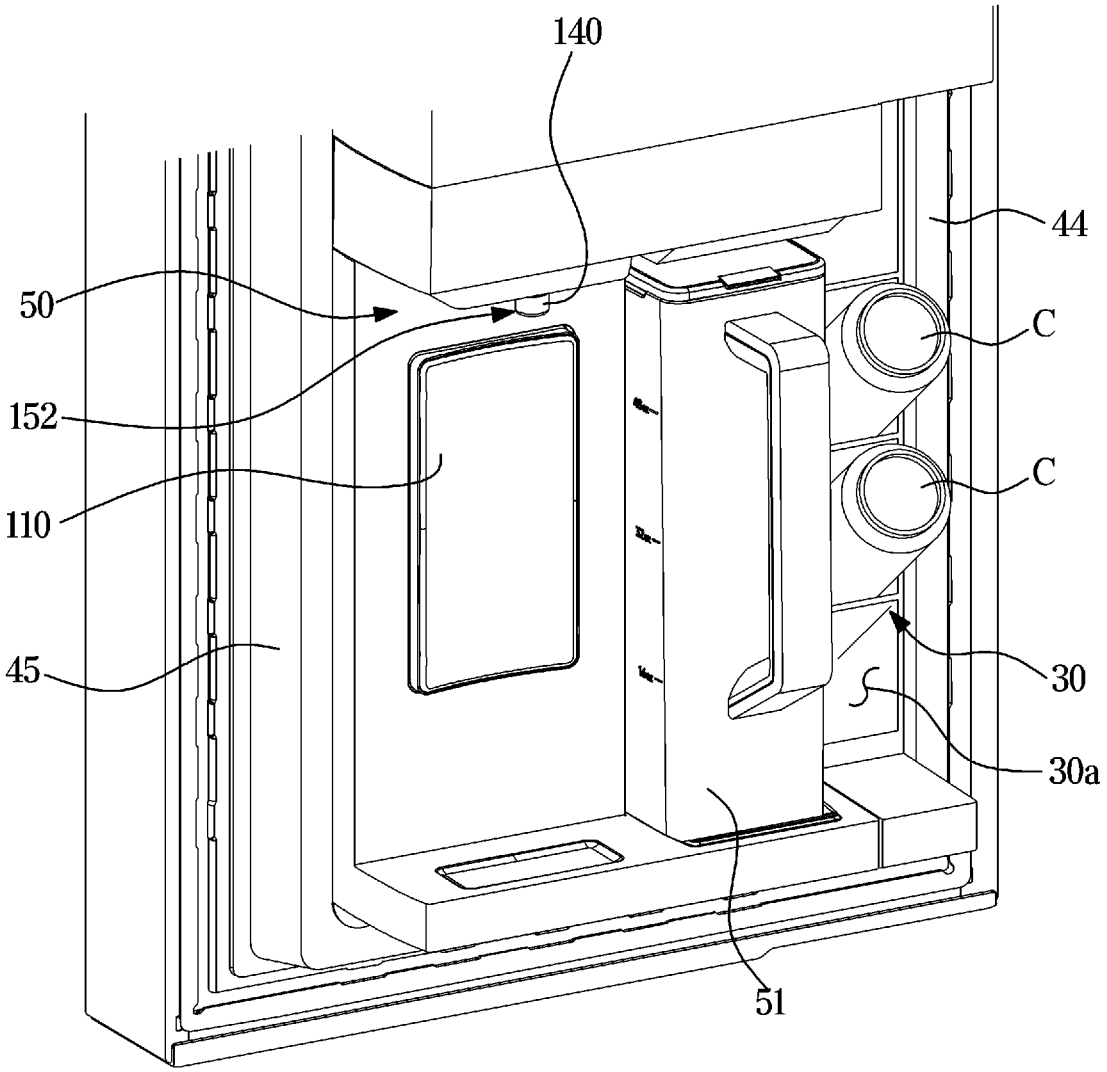
FIG. 20 shows a water supply device having a can tray according to an embodiment of the present disclosure.

FIG. 20 shows a water supply device having a can tray according to an embodiment of the present disclosure.

Referring to FIG. 20, according to an embodiment, a can tray 30, instead of the door basket 28 described above, may be installed between the water supply device 50 and the vertical dyke 44. The can tray 30 may be installed between the water supply device 50 and the vertical dyke 44 by a method of coupling a bead to a bead groove, like for the door basket 28.

The can tray 30 may include at least one can accommodating space 30*a*, and a can C, a bottle, etc. may be accommodated in the can accommodating space 30*a*. The at least one can accommodating space 30*a* may be arranged in the up-down direction, and a can C or a bottle may be accommodated obliquely in the can accommodating space 30*a*. Accordingly, a large number of the can C or bottle may be accommodated in the space between the water supply device 50 and the vertical dyke 44, thereby achieving efficient use of space.

Figure 21:
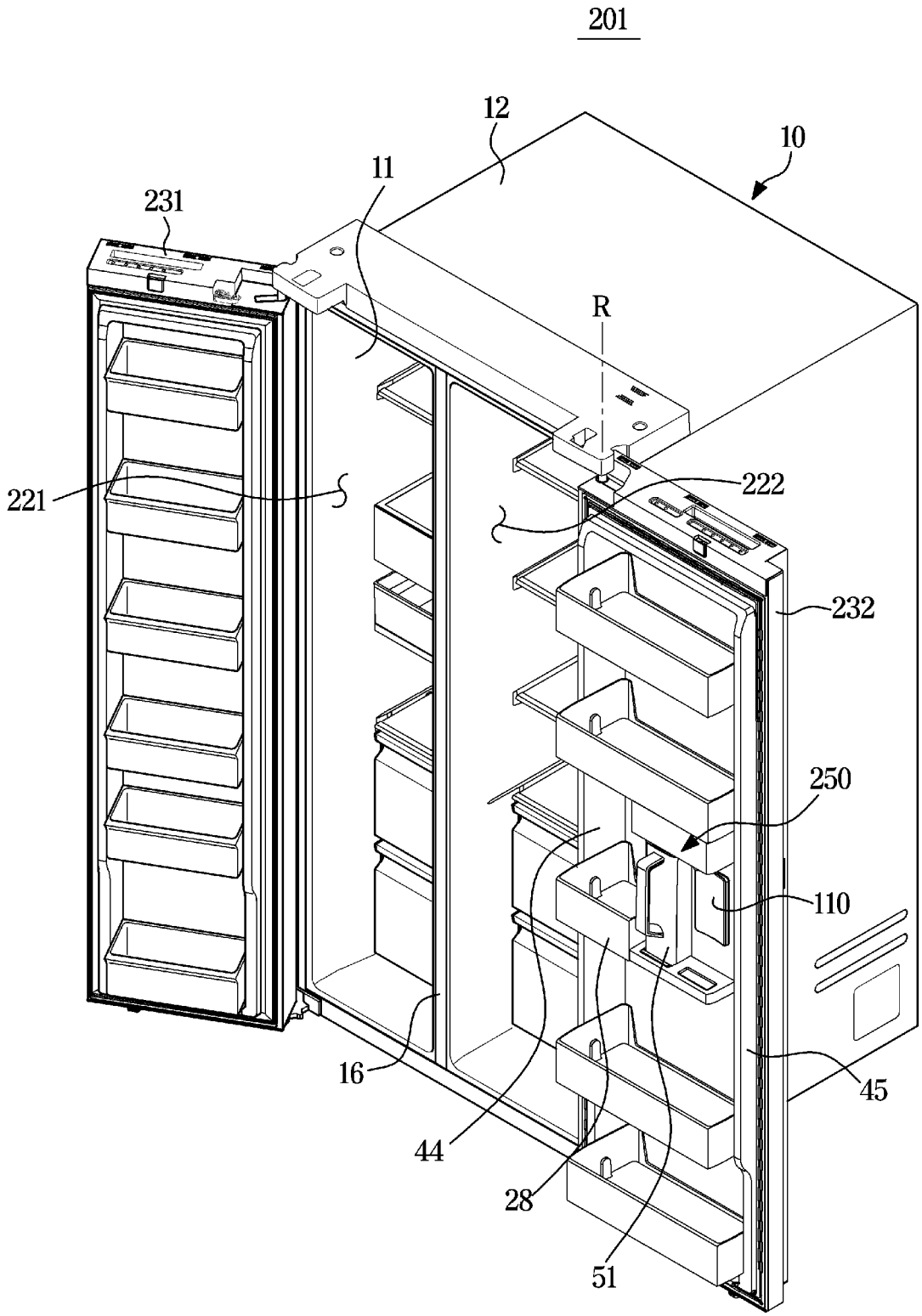
FIG. 21 shows a refrigerator according to an embodiment of the present disclosure while doors of the refrigerator open.
Figure 22:
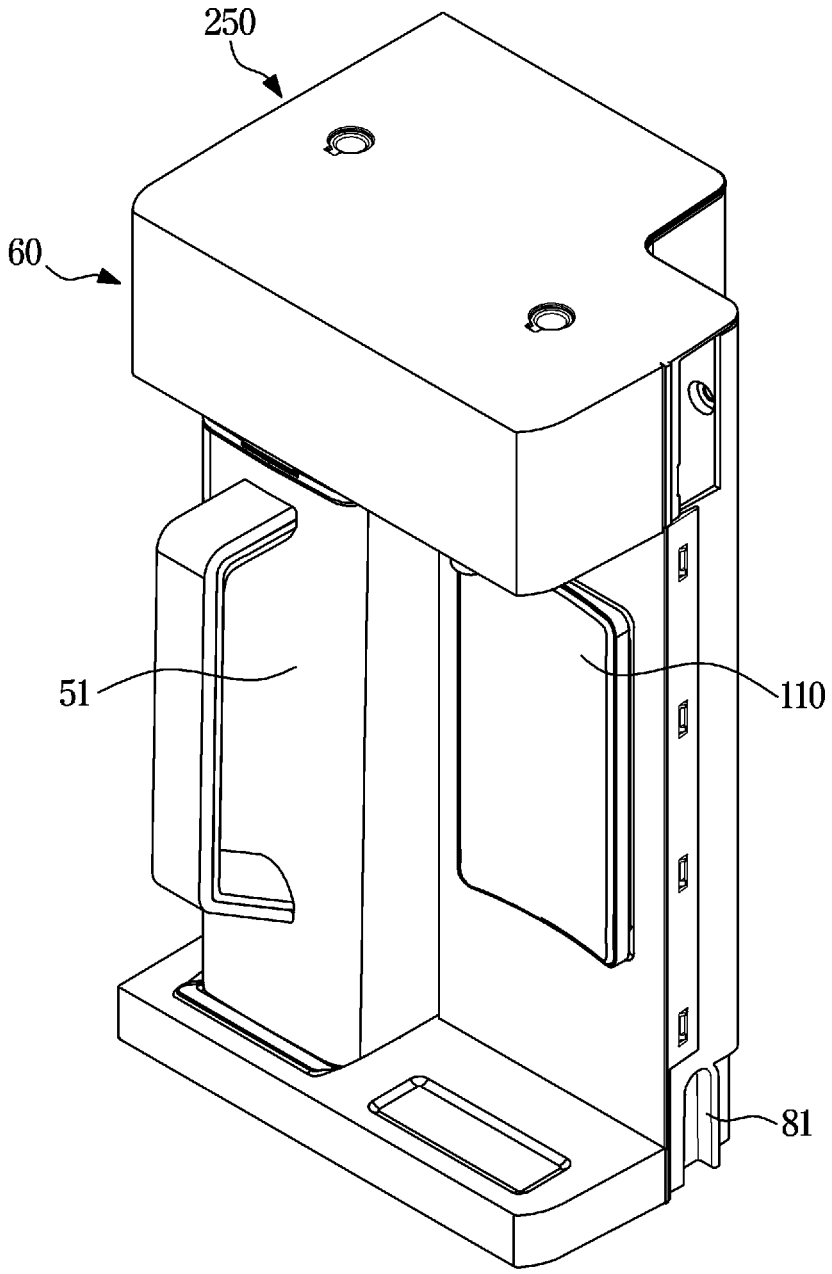
FIG. 22 shows a water supply device according to an embodiment of the present disclosure.
Figure 23:
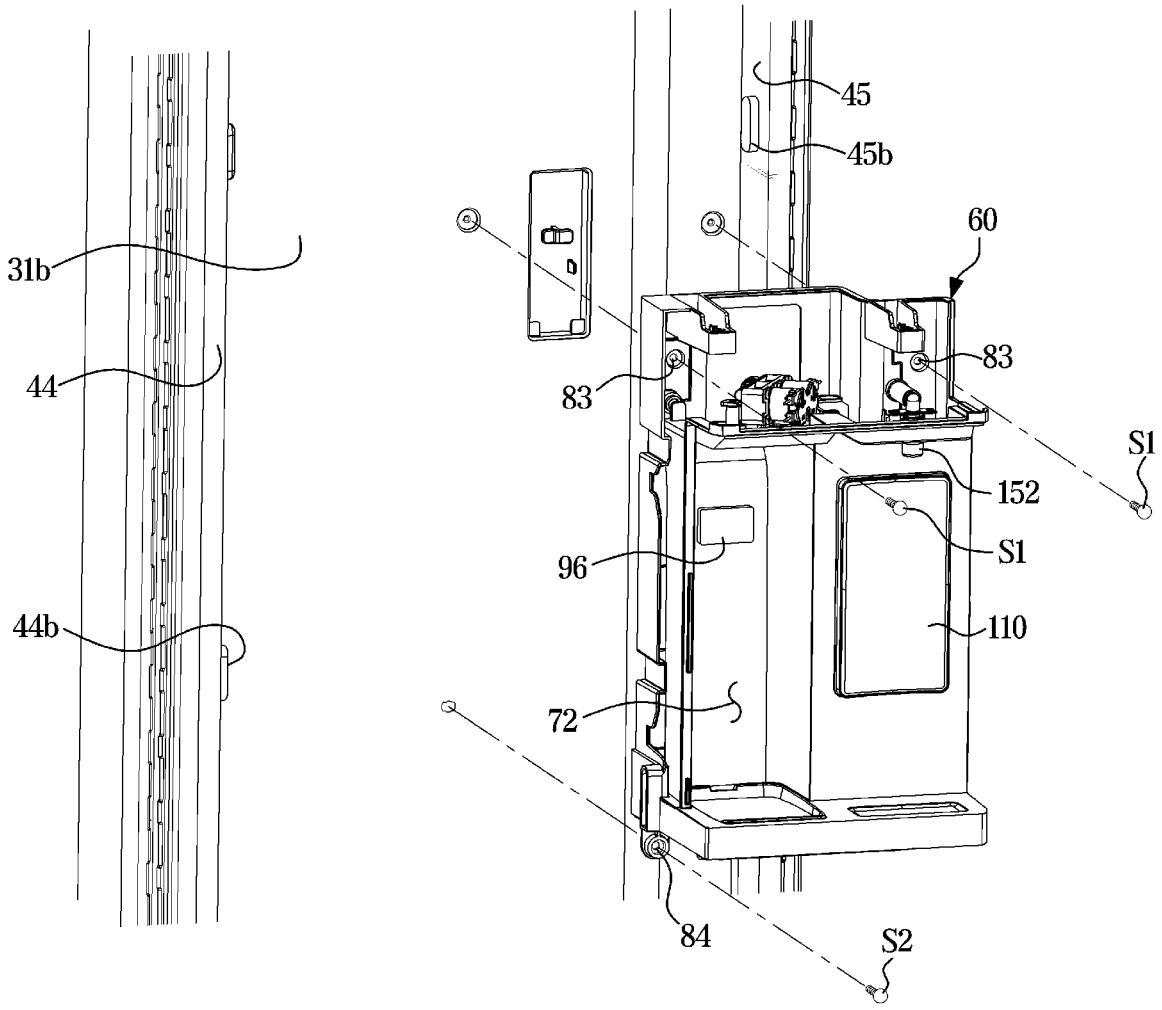
FIG. 23 shows a coupling structure of a water supply device according to an embodiment of the present disclosure.

FIG. 21 shows a refrigerator according to an embodiment of the present disclosure while doors of the refrigerator open. FIG. 22 shows a water supply device according to an embodiment of the present disclosure. FIG. 23 shows a coupling structure of a water supply device according to an embodiment of the present disclosure.

A refrigerator 201 according to an embodiment of the present disclosure will be described with reference to FIGS. 21 to 23. Like components as those described in the above-described embodiments will be assigned like reference numerals, and repeated descriptions thereof may be omitted.

According to an embodiment, the refrigerator 201 may include a SBS type refrigerator in which a refrigerating room 222 and a freezing room 221 are arranged in the left-right direction. The refrigerator 201 may include a freezing room door 231 for opening or closing the freezing room 221 and a refrigerating room door 232 for opening or closing the refrigerating room 222.

A water supply device 250 may be provided on the rear surface of the refrigerating room door 232. As in the above-described embodiment, the water supply device 250 may be positioned such that the lever 110 is farther from the rotation axis R of the refrigerating room door 232 than the water bucket 51.

Also, the water supply device 250 may be spaced from the first vertical dyke 44 that is close to the rotation axis R of the refrigerating room door 232, and coupled to the second vertical dyke 45 that is opposite to the first vertical dyke 44. The door basket 28 may be provided between the first vertical dyke 44 and the water supply device 250.

The case bead groove 81 may be provided in one surface of the water supply device 250, and the case bead groove 81 may be coupled to the dyke bead 45*b* formed in the second vertical dyke 45.

Figure 24:
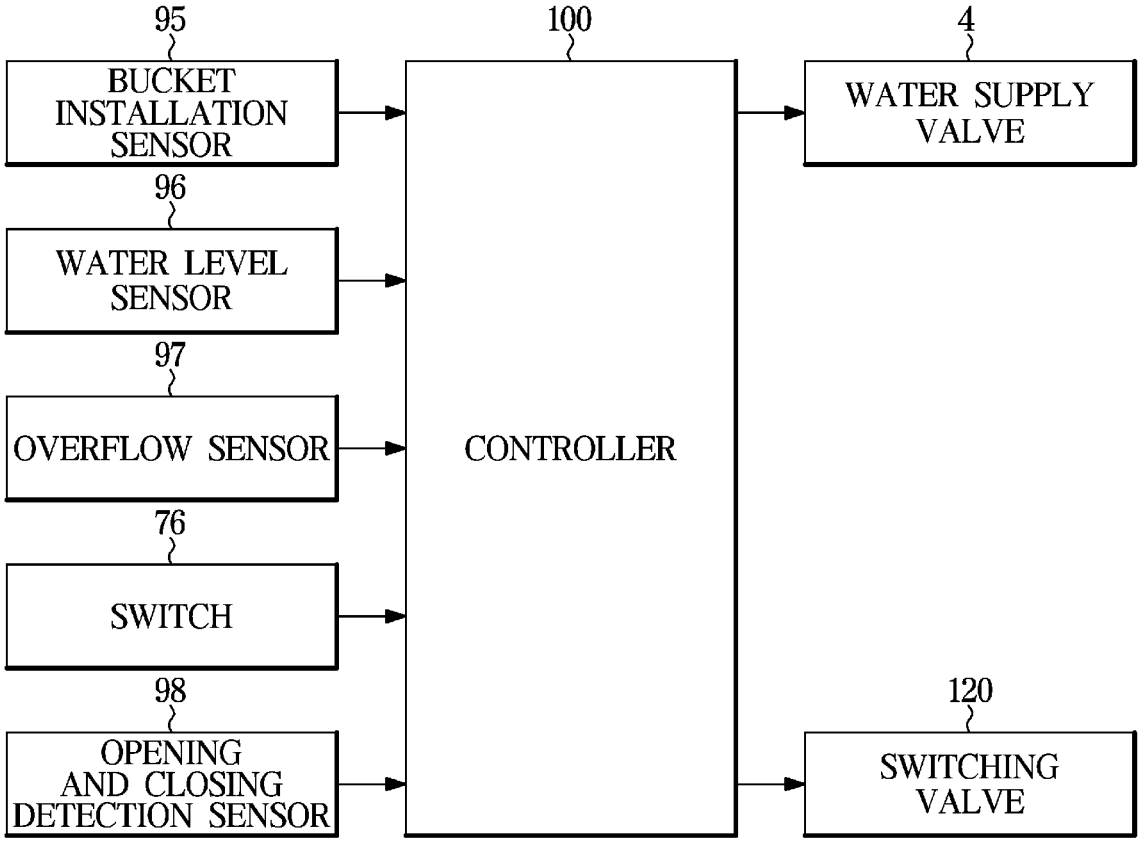
FIG. 24 is a control block diagram of a refrigerator according to an embodiment of the present disclosure.

FIG. 24 is a control block diagram of a refrigerator according to an embodiment of the present disclosure.

As shown in FIG. 24, the refrigerator 1 (or the refrigerator 201) may include the bucket installation sensor 95 for detecting installation of the water bucket 51 in the bucket installation space 72, the water level sensor 96 for detecting a water level of the water bucket 51 installed in the bucket installation space 72, the overflow sensor 97 for detecting leakage of water from the water bucket 51, the switch 76 that operates by the lever 110 pressed by a user, and an opening and closing detection sensor 98 for detecting opening and closing of the door 31 and 232.

The refrigerator 1 (or the refrigerator 201) may include a controller 100 for controlling the water supply valve 4 and the switching valve 120 based on whether the water bucket 51 has been installed, detected by the bucket installation sensor 95, information about a water level of the water bucket 51, detected by the water level sensor 96, information about overflow of the water bucket 51, detected by the overflow sensor 97, and information about opening or closing of the door 31, detected by the opening and closing detection sensor 98.

The controller 100 may control the water supply valve 4 and the switching valve 120 to supply water to the water bucket 51 according to identification that the water bucket 51 has been installed, identification that a preset amount of water has been not yet filled in the water bucket 51, and identification that no water has leaked from the water bucket 51. The controller 100 may operate the water supply valve 4 to open the water supply flow path 7 to supply water to the water bucket 51, and operate the switching valve 120 to open the first outlet port 123. While the water supply flow path 7 opens and the first outlet port 123 opens, water of the water supply source 2 may be supplied to the water bucket 51 through the first water supply port 151.

The controller 100 may operate the water supply valve 4 to open the water supply flow path 7 to supply water to the second water supply port 152, and operate the switching valve 120 to open the second outlet port 124, based on an on state of the switch 76 by the lever 110 pressed. While the water supply flow path 7 opens and the second outlet port 124 opens, water of the water supply source 2 may be supplied through the second water supply port 152.

While the door 31 and 232 opens, the water bucket 51 installed in the bucket installation space 72 may shake, and accordingly, water supplied through the first water supply port 151 may fail to be correctly supplied to the water bucket 51. Accordingly, the controller 100 may operate, while the door 31 and 232 opens, the switching valve 120 to close the first outlet port 123 to prevent water from being supplied through the first water supply port 151.

While the door 31 and 232 is closed, the lever 110 may be pressed by certain goods and thus operate wrongly. Accordingly, while the door 31 and 232 is closed, the controller 100 may operate the switching valve 120 to close the second outlet port 124 to prevent water from being supplied through the second water supply port 152.

According to an embodiment of the present disclosure, the refrigerator 1 and 201 may include the main body 10 having the storage room 21 and 222, the door 31 and 232 rotatably coupled to the main body 10 to open or close the storage room 21 and 222, and the water supply device 50 and 250 provided on the rear surface of the door 31 and 232 to be exposed to the storage room 21 and 222 while the door 31 and 232 is closed.

The water supply device 50 and 250 may include the water supply case 60 having the bucket installation space 72, the water level sensor 96 for detecting a water level of the water bucket 51 installed in the bucket installation space 72, the first water supply port 151 for supplying water to the water bucket 51 based on a water level of the water bucket 51, detected by the water level sensor 96, the lever 110 provided in the water supply case 60 to be manually operable, and the second water supply port 152 for supplying water based on a user's operation of operating the lever 110.

The second water supply port 152 may be positioned farther from the rotation axis R of the door 31 and 232 than the first water supply port 151. Accordingly, while a user receives water through the second water supply port 152, the user may receive water conveniently without interference from the water bucket 51.

The door 31 and 232 may include the pair of vertical dykes protruding in the rear direction and spaced from each other.

The pair of vertical dykes 44 and 45 may include the first vertical dyke 44 formed in one side of the door 31 and 232, the one side being adjacent to the rotation axis R of the door 31 and 232, and the second vertical dyke 45 that is opposite to the first vertical dyke 44.

The water supply case 60 may be coupled to the second vertical dyke 45, and spaced from the first vertical dyke 44.

By the structure, the water supply case 60 may be positioned as far away from the rotation axis R of the door 31 and 232 as possible, and accordingly, it may be easier to receive water by operating the lever 110.

The second vertical dyke 45 may include the dyke bead 45*b* protruding from the inner side surface 45*a* of the second vertical dyke 45.

The water supply case 60 may include the case bead groove 81 in which the dyke bead 45*b* is inserted.

By the structure, it may be possible to temporarily fix the water supply case 60 to the door 31 and 232.

The refrigerator 1 and 201 may further include the coupling member S1 and the coupling member S2 for coupling the water supply case 60 to the rear surface 31*b* of the door 31.

By temporarily fixing the water supply case 60 to the second vertical dyke 45 through the bead structure and then coupling the water supply case 60 to the rear surface 31*b* of the door 31 and 232 through the coupling member S1 and the coupling member S2, the water supply case 60 may be firmly coupled to the door 31 by a simple method.

The door 31 and 232 may include the door outer plate 40, the door inner plate 41 forming the rear surface 31*b* of the door 31 and 232 and coupled to the door outer plate 40, and the insulation 40*a* provided between the door outer plate 40 and the door inner plate 41.

The door inner plate 41 may include the inner plate hole 41*a*.

The grommet 42 may be coupled to the inner plate hole 41*a* to prevent the insulation 40*a* from entering the inside of the storage room 21 and 222.

The water supply case 60 may include the coupling hole 83 and 84.

The coupling member S1 and the coupling member S2 may be coupled to the grommet 42 by penetrating the coupling hole 83 and 84.

As such, the grommet 42 may stably couple the water supply case 60 to the door 31 and 232 while preventing the insulation 40*a* of the door 31 and 232 from leaking to the outside of the door 31 and 232.

The refrigerator 1 (or the refrigerator 201) may further include the door basket 28 installed in the space between the water supply case 60 and the first vertical dyke 44, and having the goods space 29 accommodating goods therein.

By the structure, because goods are additionally stored in the goods space 29 of the door basket 28, a storage space of the refrigerator 1 (or the refrigerator 201) may increase.

The door basket 28 may include the first basket bead groove 28*a* formed at one surface of the door basket 28 and coupled to the first vertical dyke 44, and the second basket bead groove 28*b* formed at the opposite surface of the door basket 28 and coupled to the water supply case 60.

By the structure, the door basket 28 may be easily coupled.

The first basket bead groove 28*a* may be spaced from the second basket bead groove 28*b* in the front-rear and left-right directions.

Because the first basket bead groove 28*a* is spaced from the second basket bead groove 28*b* in the front-rear and left-right directions, goods having a large size may be easily stored in the goods space 29 of the door basket 28.

The water supply case 60 may include the lever accommodating groove 73 recessed in the front surface 71 of the water supply case 60 to install the lever 110 thereon.

The lever accommodating groove 73 may include the first lever accommodating groove 74, and the second lever accommodating groove 75 formed inside the first lever accommodating groove 74 in such a way as to have a step with the first lever accommodating groove 74.

The lever 110 may include the lever frame 111 coupled to the water supply case 60 and accommodated in the second lever accommodating groove 75, and the lever body 116 rotatably coupled to the lever frame 111 and capable of being accommodated in the first lever accommodating groove 74.

By the structure, the gap between the lever 110 and the lever accommodating groove 73 may be covered. Accordingly, an aesthetic sense may be improved and foreign materials may be prevented from entering the lever accommodating groove 73, resulting in an improvement of durability of the lever 110.

The water supply case 60 may include the lever accommodating groove 273 recessed in the front surface 71 of the water supply case 60 to install the lever 110 thereon, and the cover rib 274 formed along borders of the lever accommodating groove 273 and protruding from the front surface 71 of the water supply case 60.

By the structure, the gap between the lever 110 and the lever accommodating groove 73 may be covered. Accordingly, an aesthetic sense may be improved and foreign materials may be prevented from entering the lever accommodating groove 73, resulting in an improvement of durability of the lever 110.

The water supply device 50 may include the inlet 132 and the outlet 133, and include the connection tube 130 coupled to the water supply case 60.

The water supply hose 9 for supplying water to the connection tube 130 may be connected to the inlet 132 of the connection tube 130.

The second water supply port 152 may include the water cork 140 detachably coupled to the outlet 133 of the connection tube 130.

In a process of receiving water using the lever 110, the water cork 140 may be contaminated due to water splashed to the water cork14. In this case, it may be possible to detach the water cork 140 from the connection tube 130 and wash the water cork 140.

The connection tube 130 may include the connection tube body 131, and the plurality of cork fixing rings 136 and 137 coupled to the inner circumferential surface 135 of the connection tube body 131 to fix the water cork 140.

The water cork 140 may include the water cork body 141, and the protrusion ring 142 protruding from the outer circumferential surface of the water cork body 141 to be coupled between the plurality of cork fixing rings 136 and 137.

Because the protrusion ring 142 of the water cork 140 is inserted between the plurality of cork fixing rings 136 and 137 and fixed, the water cork 140 may be easily installed and the installed water cork 140 may be not easily separated.

According to an embodiment of the present disclosure, the refrigerator 1 (or the refrigerator 201) may include the main body 10 having the storage room 21 and 222, the door 31 and 232 rotatably coupled to the main body 10 to open or close the storage room 21 and 222, and the water supply device 50 and 250 provided in the door 31 and 232.

The water supply device 50 (or the water supply device 250) may include the water supply case 60 having the lever accommodating groove 73 recessed from the front surface 71, the switch 76 provided in the lever accommodating groove 73, the lever frame 111 coupled to the water supply case 60, the lever 110 including the lever body 116 rotatably coupled to the lever frame 111 to press the switch 76, and the water supply port 152 for supplying water while the lever 110 presses the switch 76.

The lever accommodating groove 73 may include the first lever accommodating groove 74 in which the lever body 116 is accommodated, and the second lever accommodating groove 75 formed inside the first lever accommodating groove 74 in such a way as to have a step with the first lever accommodating groove 74 such that the lever frame 111 is accommodated in the second lever accommodating groove 75.

The depth of the second lever accommodating groove 75 from the front surface 71 of the case body 70 may be greater than the depth of the first lever accommodating groove 74 from the front surface 71 of the case body 70.

The water supply device 50 may have the inlet 132 and the outlet 133, and include the connection tube 130 connected to the water supply case 60.

The water supply hose 9 for supplying water to the connection tube 130 may be connected to the inlet 132 of the connection tube 130.

The second water supply port 152 151 may include the water cork 140 detachably coupled to the outlet 133 of the connection tube 130.

The connection tube 130 may include the connection tube body 131, and the plurality of cork fixing rings 136 and 137 coupled to the inner circumferential surface 135 of the connection tube body 131 to fix the water cork 140.

The water cork 140 may include the water cork body 141, and the protrusion ring 142 protruding from the outer circumferential surface of the water cork body 141 and coupled between the plurality of cork fixing rings.

According to an aspect of the present disclosure, the refrigerator may supply water according to a user's operation of manually operating the lever, or may automatically supply water to the water bucket based on a water level of the water bucket, the water level being detected by the water level sensor. Accordingly, the user may receive a small amount of water as necessary or a large amount of water at once.

According to an aspect of the present disclosure, the water supply device may have a simple structure, and may be easily assembled with the door.

According to an aspect of the present disclosure, because the lever of the water supply device is positioned farther from the rotation axis of the door than the water bucket, the user may easily operate the lever without interference from the water bucket.

According to an aspect of the present disclosure, because the door basket having a goods space is positioned in the space between the water supply device and the dyke of the door, the storage space of the refrigerator may increase.

Also, because the basket bead grooves formed at both side surfaces of the door basket to fix the door basket are not aligned with each other, the goods space of the door basket may increase.

According to an aspect of the present disclosure, because the gap between the water supply case and the lever controllably provided on the water supply case is not exposed, an aesthetic sense may be improved. Also, because foreign materials are prevented from entering the gap between the water supply case and the lever, the durability of the lever may increase.

According to an aspect of the present disclosure, it may be possible to easily separate or attach the water cork, and a coupling force of the water cork attached may be improved, which raises convenience of use.

However, aspects that may be achieved according to embodiments of the present disclosure, are not limited to the above-mentioned aspects, and other aspects not mentioned will be clearly understood by one of ordinary skill in the technical field to which the present disclosure belongs from the descriptions in the present disclosure.

Although aspects of the present disclosure has been described based on specific example embodiments, the scope of rights of the present disclosure is not limited to these example embodiments. It should be interpreted that various embodiments modified or changed by a person skilled in the art within a scope not deviating from the gist of the present disclosure also belong to the scope of rights of the present disclosure.

The invention claimed is:

1. A refrigerator comprising:
- a main body comprising a storage room;
- a door rotatably coupled to the main body and configured to open or close the storage room; and
- a water supply device on a rear surface of the door,
- wherein the water supply device comprises:
  - a water supply case comprising a bucket installation space;
  - a water level sensor configured to detect a water level of a water bucket in the bucket installation space;
  - a first water supply port configured to supply water to the water bucket based on the water level of the water bucket that is detected by the water level sensor;
  - a lever in the water supply case and configured to be manually operable; and
  - a second water supply port configured to supply water based on operation of the lever by a user,
- wherein the water supply case further comprises a coupling configured to couple the water supply case to the rear surface of the door,
- wherein the door comprises:
  - a door outer plate;
  - a door inner plate forming the rear surface of the door and coupled to the door outer plate, the door inner plate comprising an inner plate hole;
  - an insulation provided between the door outer plate and the door inner plate; and
  - a grommet configured to prevent the insulation from entering inside of the storage room, the grommet coupled to the inner plate hole,
- wherein the water supply case further comprises a coupling hole, and
- wherein the coupling is coupled to the grommet by penetrating the coupling hole.

2. The refrigerator of claim 1, wherein a distance between the second water supply port and a rotation axis of the door is larger than a distance between the first water supply port and the rotation axis.

3. The refrigerator of claim 1, wherein
- the door comprises a pair of vertical dykes protruding in a rear direction of the refrigerator and spaced from each other,
- the pair of vertical dykes comprises a first vertical dyke in a first side of the door, the first side being towards a rotation axis of the door, and a second vertical dyke that is in a second side of the door, opposite to the first vertical dyke, and the water supply case is coupled to the second vertical dyke and spaced from the first vertical dyke.

4. The refrigerator of claim 3, wherein the second vertical dyke comprises a dyke bead protruding from an inner side surface of the second vertical dyke, and the water supply case further comprises a case bead groove in which the dyke bead is inserted.

5. The refrigerator of claim 3, further comprising a door basket in a space between the water supply case and the first vertical dyke, the door basket comprising a goods space in which goods are configured to be accommodated.

6. The refrigerator of claim 5, wherein the door basket further comprises:

a first basket bead groove at one surface of the door basket and configured to couple the door basket to the first vertical dyke; and a second basket bead groove formed at another surface of the door basket, opposite to the one surface of the door basket, and configured to couple the door basket to the water supply case.

7. The refrigerator of claim 6, wherein the first basket bead groove is spaced from the second basket bead groove in front-rear and left-right directions of the refrigerator.

8. A refrigerator comprising:

a main body comprising a storage room;

a door rotatably coupled to the main body and configured to open or close the storage room; and a water supply device on a rear surface of the door, wherein the water supply device comprises:

a water supply case comprising a bucket installation space;

a water level sensor configured to detect a water level of a water bucket in the bucket installation space;

a first water supply port configured to supply water to the water bucket based on the water level of the water bucket that is detected by the water level sensor;

a lever in the water supply case and configured to be manually operable; and a second water supply port configured to supply water based on operation of the lever by a user, wherein the water supply case further comprises a lever accommodating groove recessed from a front surface of the water supply case, wherein the lever is on the lever accommodating groove, and wherein the lever accommodating groove comprises a first lever accommodating groove, and a second lever accommodating groove formed inside the first lever accommodating groove in such a way as to form a step with the first lever accommodating groove.

9. The refrigerator of claim 8, wherein the lever comprises a lever frame coupled to the water supply case and accommodated in the second lever accommodating groove, and a lever body rotatably coupled to the lever frame and configured to be accommodated in the first lever accommodating groove.

10. A refrigerator comprising:

a main body comprising a storage room;

a door rotatably coupled to the main body and configured to open or close the storage room; and a water supply device on a rear surface of the door, wherein the water supply device comprises:

a water supply case comprising a bucket installation space;

a water level sensor configured to detect a water level of a water bucket in the bucket installation space;

a first water supply port configured to supply water to the water bucket based on the water level of the water bucket that is detected by the water level sensor;

a lever in the water supply case and configured to be manually operable; and a second water supply port configured to supply water based on operation of the lever by a user, wherein the water supply case further comprises a lever accommodating groove recessed from a front surface of the water supply case, wherein the lever is on the lever accommodating groove, and wherein the refrigerator further comprises a cover rib protruding from the front surface of the water supply case along borders of the lever accommodating groove.

11. A refrigerator comprising:

a main body comprising a storage room;

a door rotatably coupled to the main body and configured to open or close the storage room; and a water supply device on a rear surface of the door, wherein the water supply device comprises:

a water supply case comprising a bucket installation space;

a water level sensor configured to detect a water level of a water bucket in the bucket installation space;

a first water supply port configured to supply water to the water bucket based on the water level of the water bucket that is detected by the water level sensor;

a lever in the water supply case and configured to be manually operable; and a second water supply port configured to supply water based on operation of the lever by a user, wherein the water supply device further comprises a connection tube that comprises an inlet and an outlet, the connection tube coupled to the water supply case, wherein the refrigerator further comprises a water supply hose configured to supply water to the connection tube, the water supply hose connected to the inlet of the connection tube, and wherein the second water supply port comprises a water cork detachably coupled to the outlet of the connection tube.

12. The refrigerator of claim 11, wherein the connection tube further comprises a connection tube body, and a plurality of cork fixing rings coupled to an inner circumferential surface of the connection tube body and configured to fix the water cork.

13. The refrigerator of claim 12, wherein the water cork comprises a water cork body, and a protrusion ring protruding from an outer circumferential surface of the water cork body, and the protrusion ring is configured to be coupled between the plurality of cork fixing rings.

* * * * *